US008084170B2

(12) United States Patent
Kami et al.

(10) Patent No.: US 8,084,170 B2
(45) Date of Patent: Dec. 27, 2011

(54) ELECTROPHOTOGRAPHIC PHOTOCONDUCTOR, ELECTROPHOTOGRAPHIC PROCESS CARTRIDGE CONTAINING THE SAME AND ELECTROPHOTOGRAPHIC APPARATUS CONTAINING THE SAME

(75) Inventors: Hidetoshi Kami, Numazu (JP); Tetsuro Suzuki, Fuji (JP); Hiroshi Tamura, Susono (JP); Hiroshi Ikuno, Yokohama (JP); Yukio Fujiwara, Numazu (JP); Takafumi Iwamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 782 days.

(21) Appl. No.: 12/047,011

(22) Filed: Mar. 12, 2008

(65) Prior Publication Data

US 2008/0227008 A1 Sep. 18, 2008

(30) Foreign Application Priority Data

Mar. 13, 2007 (JP) ..... 2007-063338

(51) Int. Cl.
*G03G 5/047* (2006.01)
*G03G 5/147* (2006.01)

(52) U.S. Cl. ..... 430/59.6; 430/66; 430/67; 399/159

(58) Field of Classification Search ..... 430/66, 430/67, 59.6; 399/159
See application file for complete search history.

(56) References Cited

U.S. PATENT DOCUMENTS 5,322,753 A 6/1994 Tamura et al.
5,393,628 A * 2/1995 Ikezue et al. ..... 430/58.5
5,488,137 A 1/1996 Tamura et al.
5,492,784 A 2/1996 Yoshikawa et al.
5,608,010 A 3/1997 Tamura et al.
5,871,876 A 2/1999 Ikuno et al.
6,030,733 A 2/2000 Kami et al.
6,066,428 A 5/2000 Katayama et al.
6,071,660 A * 6/2000 Black et al. ..... 430/59.6
6,151,468 A 11/2000 Kami et al.
6,194,535 B1 2/2001 Katayama et al.
6,210,848 B1 4/2001 Nagai et al.
6,432,596 B2 8/2002 Ikuno et al.
6,560,427 B2 5/2003 Kubo et al.
6,686,114 B2 2/2004 Sakon et al.
6,861,188 B2 3/2005 Ikegami et al.
6,998,209 B2 2/2006 Ikuno et al.
7,175,957 B2 2/2007 Suzuki et al.
7,177,570 B2 2/2007 Nagame et al.
7,179,573 B2 2/2007 Suzuki et al.
7,189,487 B2 3/2007 Ikuno et al.
7,251,437 B2 7/2007 Tamoto et al.
7,267,916 B2 9/2007 Sugino et al.
7,279,260 B2 10/2007 Nagai et al.
7,314,693 B2 1/2008 Ikegami et al.
7,315,722 B2 1/2008 Kitajima et al.
7,341,814 B2 3/2008 Kami et al.
7,348,113 B2 3/2008 Shoshi et al.
7,361,438 B2 4/2008 Suzuki et al.
7,371,490 B2 5/2008 Tamoto et al.
2003/0059695 A1* 3/2003 Li et al. ..... 430/66
2005/0008957 A1 1/2005 Ikegami et al.
2005/0026058 A1 2/2005 Kami et al.
2005/0158641 A1 7/2005 Yanagawa et al.
2005/0158644 A1 7/2005 Kondo et al.
2005/0221210 A1 10/2005 Suzuki et al.
2005/0238987 A1 10/2005 Ohshima et al.
2005/0266325 A1 12/2005 Yanagawa et al.
2005/0266328 A1* 12/2005 Yanagawa et al. ..... 430/66
2005/0282075 A1 12/2005 Ikuno et al.
2005/0287452 A1 12/2005 Tamura et al.
2005/0287465 A1 12/2005 Ohshima et al.
2006/0014093 A1 1/2006 Li et al.
2006/0014096 A1 1/2006 Ohshima et al.
2006/0051689 A1 3/2006 Suzuki et al.
2006/0068308 A1 3/2006 Ohshima et al.
2006/0093955 A1 5/2006 Ohshima et al.
2006/0110668 A1 5/2006 Kawasaki et al.
2006/0160003 A1 7/2006 Nagai et al.
2006/0177749 A1 8/2006 Tamoto et al.
2007/0009818 A1 1/2007 Yanagawa et al.
2007/0031746 A1 2/2007 Toshine et al.
2007/0154825 A1 7/2007 Tamoto et al.
2007/0196749 A1 8/2007 Inaba et al.
2007/0196750 A1 8/2007 Fujiwara et al.
2007/0212625 A1 9/2007 Suzuki et al.
2007/0212626 A1 9/2007 Toshine et al.
2007/0212627 A1 9/2007 Yanagawa et al.
2007/0231720 A1 10/2007 Mori et al.
2007/0269729 A1 11/2007 Ikuno et al.
2007/0292780 A1 12/2007 Nagai et al.
2008/0085459 A1 4/2008 Kami et al.

FOREIGN PATENT DOCUMENTS

EP 1 184 732 A2 3/2002

(Continued)

OTHER PUBLICATIONS

Nobuo Hyakutake, et al., "Blade cleaning system for polymerized and small size toner", Research & Development Center, DPC, Fuji, Xerox Co., Ltd., Hardcopy Fall Meeting, 14 pages (with English translation).

*Primary Examiner* — Christopher Rodee
(74) *Attorney, Agent, or Firm* — Oblon, Spivak, McClelland, Maier & Neustadt, L.L.P.

(57) ABSTRACT

An object of the present invention is to provide an electrophotographic photoconductor having an extremely low increase in friction coefficient and wear, while also having superior cleanability even after long-term or large-volume printing, and to provide an electrophotographic apparatus for forming an image using a polymerization toner without providing a unit for externally supplying a lubricant to a photoconductor. Namely, the present invention provides an electrophotographic photoconductor having a photosensitive layer and a crosslinked resin surface layer over a conductive substrate, wherein the crosslinked resin surface layer at least contains trimethylolpropane triacrylate, a dimethylpolysiloxane having a radically polymerizable functional group, and lubricating fine particles.

4 Claims, 7 Drawing Sheets

FOREIGN PATENT DOCUMENTS

| | | |
|---|---|---|
| JP | 7-13381 | 1/1995 |
| JP | 10-142816 | 5/1998 |
| JP | 11-218953 | 8/1999 |
| JP | 11-272003 | 10/1999 |
| JP | 2001-242758 | 9/2001 |
| JP | 2002-149031 | 5/2002 |
| JP | 2002-189312 | 7/2002 |
| JP | 2004-279518 | 10/2004 |
| JP | 2005-62830 | 3/2005 |
| JP | 2005-115353 | 4/2005 |
| JP | 2005-208112 | 8/2005 |
| JP | 2005-227742 | 8/2005 |

* cited by examiner

ELECTROPHOTOGRAPHIC PHOTOCONDUCTOR, ELECTROPHOTOGRAPHIC PROCESS CARTRIDGE CONTAINING THE SAME AND ELECTROPHOTOGRAPHIC APPARATUS CONTAINING THE SAME

BACKGROUND OF THE INVENTION

1. Field of the Invention

The present invention relates to an electrophotographic apparatus and an electrophotographic cartridge. The electrophotographic apparatus and the electrophotographic cartridge of the present invention are applied to a photocopier, facsimile machine, laser printer or direct digital platesetter and the like.

2. Description of the Related Art

Although the electrophotographic photoconductors used in electrophotographic apparatuses applied to photocopiers, laser printers and the like formerly consisted primarily of inorganic photoconductors such as selenium, zinc oxide and cadmium sulfate, organic photoconductors (OPC), which are more advantageous than inorganic photoconductors in terms of reducing the burden on the global environment, reducing costs and allowing greater freedom of design, are currently used at a rate that is rapidly approaching 100% of the total production volume of electrophotographic photoconductors.

In recent years, accompanying greater importance being placed on production in consideration of protecting the global environment, the role of photoconductors is required to change from that of consumable supplies (disposable products) to mechanical components. In order to achieve this, it is necessary for photoconductors to offer a longer service life, and in order to respond to this need, it has become common to add a protective layer onto the photosensitive layer.

In addition, the use of polymerization toners (spherical toners) is becoming increasingly common for the toners for development used in electrophotography for reasons of improved reduction in the burden placed on the environment during toner production as well as being advantageous in terms of achieving high image quality.

This polymerization toner (spherical toner) is a spherically shaped toner that is free of corners, and is produced by chemical production processes such as suspension polymerization, emulsion aggregation polymerization, ester elongation polymerization or dissolution suspension. Polymerization toners have different shapes depending on the production process, and the polymerization toner used in image forming apparatuses has a shape that is slightly distorted from being perfectly round. Typical characteristic values consist of an average circularity of 0.95 to 0.99, values of 110 to 140 for shape factors SF-1 and SF-2, and although polymerization toners having a particle size distribution of ±0.5 μm can be produced, those having a particle size distribution of ±1 μm to 2 μm are typically used. Those having an average circularity of 1.0 and value of 100 for shape factors SF-1 and SF-2 are perfectly round.

Since polymerization toners have a uniform shape, the charge they possess can be made to be uniform comparatively easily. In addition, wax and the like can also be added easily (5% to 10%). Thus, since there is hardly any overflow from latent electrostatic images, polymerization toners have satisfactory developing ability, superior sharpness, resolution and contrast and satisfactory transfer efficiency. In addition, they also have numerous advantages such as oilless transfer.

On the other hand, this type of toner is known to be associated with difficulties in cleaning, and numerous countermeasures for this have been proposed in the patent literature.

In general, in order to ensure adequate cleanability for these toners, it is desirable that the surface of the photoconductor has a low friction coefficient and that the friction coefficient be maintained during repeated use.

For example, cleaning performance of a polymerization toner is known to be secured by lowering the friction coefficient of a photoconductor surface by coating the surface thereof with a lubricant such as zinc stearate (to simply be referred to as lowering the surface energy) (Nobuo Hyakutake, Akihisa Maruyama, Satoru Shigesaki, Sachie Okuyama: Japan Hardcopy Fall Meeting, 24-27, 2001).

However, when a lubricant is externally added and supplied to the surface of a photoconductor, the lubricant is mixed into the toner to be recycled, resulting in degradation of the toner. In addition, if a lubricant that has degraded in the charging step and so forth remains on the surface of the photoconductor, there are problems such as occurrence of image flow and poor performance of the cleaning blade.

Another typically known method involves the containing of a lubricant such as a silicone compound, fluorine resin fine particles or fatty acid ester in the outermost surface of a photoconductor. A means for containing fluorine atom-containing resin fine particles in the outermost layer of a photoconductor is proposed for the cleanability of polymerization toners in particular (for example, Japanese Patent Application Laid-Open (JP-A) Nos. 11-218953 and 11-272003).

The energy on the surface of a photoconductor is effectively lowered by containing fluorine atom-containing resin fine particles. However, the friction coefficient on the photoconductor surface is increased by endurance, and it is difficult to maintain the initial surface friction coefficient only by containing fluorine atom-containing resin fine particles. In this case, the friction coefficient of the photoconductor surface is increased soon after started to use, and cleanability becomes insufficient. Thus, it is necessary to replace the photoconductor.

In addition, it is necessary to contain fluorine atom-containing resin fine particles at a prescribed concentration or more in order to reduce the friction coefficient of the photoconductor surface, in this case, the film strength is weakened as is described in the paragraph [0001] of JP-A No. 07-13381 and the paragraph [0026] of JP-A No. 10-142816. In addition, there are many cases in which wear resistance of the photoconductor is decreased by containing fluorine atom-containing resin fine particles even if it is prepared to the contained amounts defined in the patent literature.

As current needs, it is determined that an electrophotographic photoconductor maintaining both high wear resistance and a low surface friction coefficient is demanded. Naturally, high sensitivity and stable characteristics with respect to environmental changes are also essential. However, a method of satisfying these demands has yet to be found.

In the most common electrophotographic apparatuses in use today, the cleaning blade accounts for the majority of the cleaning performance of polymerization toners. Thus, it is advisable to enhance the cleaning performance of the cleaning blade in order to enhance the cleanability of the polymerization toner.

The cleaning failure of polymerization toner is thought to be caused by an imbalance in the contact conditions between the cleaning blade and the photoconductor (for example, JP-A No. 2001-242758) and the toner itself getting beneath the portion contacted by the cleaning blade (for example, JP-A No. 2002-189312). If the frictional resistance between the cleaning blade and photoconductor is high, the edge of the blade is completely dragged in the driving direction of the photoconductor. Moreover, when the photoconductor and blade edge unevenly contact and cause chatter, the blade edge may be twisted or lifted and then a gap is formed. The toner moves into the gap, rolling into the gap, and then escapes because of its spherical shape. If the toner escapes in this manner, the toner continues to successively enter the gap and cleaning failure occurs.

In order to retain the toner with the cleaning blade, it is important to set suitable conditions for the contacting the cleaning blade to the photoconductor while also stabilizing those conditions.

The contact conditions are made unsuitable by the following factors.

(1) Large Frictional Resistance Between Photoconductor and Cleaning Blade

If the frictional resistance between the cleaning blade and photoconductor is excessively large, the entire contact site of the cleaning blade has difficulty in uniformly contacting the driving photoconductor. At this time, the edge of the cleaning blade is dragged in the driving direction of the photoconductor and contact pressure is no longer applied uniformly, thereby resulting in distortion and twisting or causing vibrations such as chattering. Consequently, toner escapes.

(2) Chipping of the Blade Edge

If the edge of the cleaning blade is chipped, the cleaning failure in the form of lines occurs, and the width and density of the lines are different depending on the size of the missing portions. Even if there are some missing portions in the blade edge, the contact pressure is still effective and the blade edge becomes flattened so as to cover the missing portions. Thus, few problems occur. The excessively large missing portions cannot be adequately prevented, and causes the cleaning failure in lines, which may eventually lead to cleaning failure.

Although there are several causes for the occurrence of chipping of the edge of the cleaning blade, particular caution is required with respect to accumulation of fatigue in the blade edge caused by excessive contact pressure of the cleaning blade or a large friction coefficient of the photoconductor, and the adhesion of substances such as the carrier (magnetic particles) or toner film to the surface of the photoconductor continuously contacting with the blade edge.

(3) Unsuitable Blade Contact Pressure

As the set value of the blade contact pressure is higher, a gap is difficultly formed between the photoconductor and edge of the cleaning blade, thereby improving cleaning failure. However, the photoconductor having a high friction coefficient may cause inversion or locking of the blade, deformation of the blade, the occurrence of sticking and slipping phenomena, increased wear of the photoconductor, scratches and accelerated wear and deformation of the cleaning blade. Thus, the cleaning failure easily occurs.

In addition, when the surface area of the photoconductor contact site of the cleaning blade is increased, the maximum value of the pressure distribution of the contact portion is decreased. As a result, the force that enables a toner to be retained by the cleaning blade may be decreased.

On the other hand, when the contact pressure of the cleaning blade is low, the load on the photoconductor and cleaning blade is decreased thereby increasing mechanical durability, but the penetration of toner beneath the cleaning blade. In the case where the photoconductor and cleaning blade are not in a good status, the cleaning failure more easily occurs.

As has been described above, when the pressing pressure (linear pressure) of the cleaning blade on the photoconductor is increased, the cleaning failure may be improved, but, the wear of the blade edge may be accelerated and the force used to retain the toner is easily decreased. Thus, a strategy and photoconductor capable of inhibiting the wear of the blade edge are required.

(4) Large Surface Roughness of the Photoconductor

When the surface roughness of the photoconductor is excessively large, the adherence of the cleaning blade to the photoconductor surface becomes inadequate. The chips formed in the blade edge, or the vibration of the blade edge may be more easily form a gap.

For example, when a toner is embedded in indentations in the photoconductor surface, which forms an escape path where the cleaning blade passes over the toner.

A toner and paper dust adhesion and damage to the photoconductor surface may cause increased surface roughness of the photoconductor.

Reducing the friction coefficient of the photoconductor surface and maintaining a low friction coefficient are advantageous for resolving these problems associated with contact conditions. This is because pulling of the cleaning blade in the driving direction of the photoconductor is alleviated by reducing the frictional force between the photoconductor and the cleaning blade. In addition, the inventors of the present invention confirmed experimentally that the depth to which chips form in the blade edge can be allowed to about 70 μm when the contact pressure of the cleaning blade is set to 22 g/cm to 25 g/cm in an electrophotographic apparatus using a polymerization toner, and a photoconductor having a friction coefficient of about 0.2 to 0.3 is used. Thus, in case of chipping of the edge of the cleaning blade, the robustness of the cleaning blade on cleaning performance is enhanced by decreasing the friction coefficient (disclosed in JP-A No. 2004-279518).

In addition, it is also possible to enhance to a certain extent the toner cleanability of an apparatus by increasing the contact pressure of the cleaning blade. However, since the load increase accelerates wear of the cleaning blade edge, thus, this is not suited for extending the service life of the apparatus. The increase of the contact pressure also acts advantageously in photoconductors having a low friction since the wear rate is inhibited. In addition, the excellent cleanability of the polymerization toner can be acquired depending on the selection of the photoconductor, provided that surface roughness of the photoconductor can be reduced.

Methods for reducing the friction of the surfaces of photoconductors have long been studied, and the method of containing a lubricant in the form of a silicone oil or fluorine resin fine particles into the surface layer of a photoconductor is widely known. A lubricant is contained in a condition of a high concentration in the surface layer of the photoconductor so as to maintain the low friction (JP-A No. 2005-62830).

In addition, a photoconductor has been proposed that realizes both wear resistance and electrical characteristics of the surface layer by containing resin fine particles in a crosslinked polymer layer obtained by curing a radically polymerizable monomer having three or more functional groups not having a charge transporting structure and a radically polymerizable compound having a charge transporting structure (JP-A Nos. 2005-227742 and 2005-208112).

However, by containing a large amount of a lubricant in the photoconductor surface layer, the enhancement of wear resistance is limited. Thus, it has been desired that a low friction of the photoconductor can be maintained without containing a lubricant.

As a photoconductor capable of maintaining a low friction without containing a lubricant, it has been proposed that an electrophotographic photoconductor having a crosslinked layer obtained by curing a radically polymerizable monomer having three or more functional groups but not having a charge transporting structure, a radically polymerizable compound having a charge transporting structure and a single functional group, and a reactive silicone compound having a radically polymerizable functional group and a dimethylsiloxane structure as a repeating unit (JP-A No. 2005-115353). In this electrophotographic photoconductor, a silicone oil is chemically bonded to a three-dimensional crosslinked resin matrix so as to prevent in advance any loss of lubricant caused by bleedout. However, the electrophotographic photoconductor has the problem of toner escaping during cleaning when using a toner having high circularity such as polymerization toner.

BRIEF SUMMARY OF THE INVENTION

An object of the present invention is to provide an electrophotographic photoconductor having an extremely low increase in friction coefficient and wear while also having superior cleanability even after long-term or large-volume printing. In addition, an object of the present invention is to provide an electrophotographic apparatus for forming an image using a polymerization toner without providing a unit for externally supplying a lubricant to a photoconductor.

In order to solve the conventional problems, the inventors of the present invention found that loss of lubricant due to bleedout can be prevented in advance by selecting a three-dimensionally crosslinked film for the material of the a photoconductor surface layer which forms a film by radial polymerization of trimethylolpropane triacrylate having a high crosslink density, selecting dimethylpolysiloxane which is one of silicone oil having a superior effect of reducing friction coefficient from among various lubricants, and then chemically bonding the dimethylpolysiloxane to a three-dimensionally crosslinked resin matrix of the material of the photoconductor surface layer.

Generally, the low friction of a photoconductor is temporarily lost in a charging step of an electrophotographic process. With regard to this phenomenon, it was found that the loss of low friction can be avoided by dispersing a second component of a lubricant in the form of unreactive lubricating fine particles. In the case of only using the unreactive lubricating fine particles alone, a large amount of the unreactive lubricating fine particles are necessarily contained to maintain the low friction of a photoconductor. While a chemically-bonding dimethylpolysiloxane is used with lubricating fine particles, a large amount of the lubricating fine particles are not needed. Consequently, deterioration of film strength caused by containing a large amount of lubricant can be suppressed.

A crosslinked film of trimethylolpropane triacrylate demonstrates extremely superior effects of wear resistance. This is thought to be attributable to the high crosslink density of the material. In addition, the ease of formation of a crosslinked film and the highly reactive properties are presumed to allow a chemically-bonding dimethylpolysiloxane to be easily chemically bonded. Thus, it is advantageous for dimethylpolysiloxane to have a radically polymerizable functional.

In addition, an acrylic-silicone copolymer, fluorine resin fine particles and polyethylene wax were found to have excellent dispersibility relative to coatings containing dimethylpolysiloxane and trimethylolpropane triacrylate.

The application of a coating having this favorable dispersibility allows to form a homogeneous film having few surface irregularities, and also to demonstrate excellent cleanability even when using a toner having high circularity such as polymerization toner.

However, when the concentration of lubricating component contained in the surface layer is excessively low, low friction is unable to be maintained. On the other hand, when an excessive amount of the lubricating component is contained, problems attributable to the incorporation of a lubricant are intensified during actual use, such as impairment of the desired wear resistance or being unable to obtain sensitivity in terms of electrostatic characteristics, particularly in the case of a cured film consisting of crosslinked trimethylolpropane triacrylate. In order to avoid these problems, the content of a lubricating component combining the dimethylpolysiloxane and lubricating fine particles is 5% by mass to less than 20% by mass of the mass of the solid content of the surface layer, and the dimethylpolysiloxane and the lubricating fine particles are mixed at a mass ratio of 3:7 to 7:3. The range of the lubricant content may be adjusted corresponding to the type of electrophotographic apparatus, such as the case of using a Scorotron type charger for the charging unit or using a charging roller for superimposing an AC component.

The chemically-bonding dimethylpolysiloxane preferably causes radical reaction with the trimethylolpropane triacrylate for the purpose of preventing loss caused by bleedout. The use of a material having a methacryloyl group is advantageous since many photoconductor surface layers are homogeneously formed.

In addition, it has been also found that the dimethylpolysiloxane component having a rather large molecular mass is effective in low friction. Consequently, materials having a radically polymerizable functional group on one end thereof are preferable since a large molecular mass can be obtained on the end. More specifically, a material in which the molecular mass per mol of radically polymerizable functional group is 2,400 g/mol or more is preferable. Although the details of the cause thereof are unclear, the dimethylpolysiloxane orienting to the photoconductor surface affects the number of chemical bonds and molecular mass, and materials having a large molecular mass and high degree of freedom are thought to act advantageously.

Low friction is favorably maintained when the lubricating fine particles having a primary particle diameter of 0.05 μm to 1 μm is used in combination in the present invention. Although the details regarding this are unclear, fine particles appearing on the surface of the photoconductor are spread over the entire surface thereof with a member such as the cleaning blade and the like to slide over the photoconductor. In contrast, when the particle diameter is less than 0.05 μm, the lubricating fine particles may be rubbed off outside the photoconductor system with abrasion powder. Consequently, it is thought to be difficult to express the desired effect. In addition, materials having a large particle diameter are unstable because the low friction may be maintained at certain times but not be maintained at other times. The lubricating fine particles preferably have a primary particle diameter of 0.05 μm to 1 μm to obtain maintained low friction by containing the lubricating fine particles.

In addition, the dimethylpolysiloxane and the lubricating fine particles are preferably mixed at a mass ratio of 3:7 to 7:3. Mixing at a ratio within this range lowers escape degree and further improves cleanability.

Since the lubricating fine particles have superior lubricating effects in combination with the chemically-bonding dimethylpolysiloxane and have excellent dispersibility in a coating containing dimethylpolysiloxane and trimethylolpropane triacrylate, the lubricating fine particles may contain fluorine resin fine particles, acrylic-silicone copolymers or low molecular mass polyethylene wax.

With respect to fluorine resin fine particles in particular, polytetrafluoroethylene and/or tetrafluoroethylene-perfluoroalkyl vinyl ether copolymers are easily acquired as commercial products and are effective in imparting low friction, thereby making them highly advantageous.

Depending on the case, with respect to the low friction of a photoconductor surface, the silicone component of the photoconductor surface may be temporarily lost due to the severe load in the charging step. However, in the case of the above-described configuration, the low friction is recovered rapidly.

A radically polymerizable silicone segment and fluorine resin fine particles having low affinity are effectively mixed to use, because it is thought that the fluorine resin fine particles have an effect of excluding the radically polymerizable silicone segment from the film. In the present invention, the selection of components having low mutual solubility in the manner of fluorine resin fine particles for the excluding component of a crosslinkable silicone is particularly advantageous.

Separate from the above, a crosslinked monofunctional radically polymerizable compound having a charge transporting structure is preferably contained. A charge transporting substance having a structure represented by General Formula 1 is useful for obtaining high sensitivity in a photoconductor using a crosslinked resin surface layer of a curable resin, and 5% by mass to less than 60% by mass of the transporting substance is preferably contained in the crosslinked resin surface layer.

graphic photoconductor according to any of <1> to <17> described below are provided.

<1> An electrophotographic photoconductor containing a conductive substrate; a photosensitive layer over the conductive substrate; and a crosslinked resin surface layer over the conductive substrate, wherein the crosslinked resin surface layer contains at least trimethylolpropane triacrylate, a dimethylpolysiloxane having a radically polymerizable functional group, and lubricating fine particles, the lubricating fine particles containing at least an acrylic-silicone copolymer, and wherein the total mass of the dimethylpolysiloxane and the lubricating fine particles is 5% by mass to less than 20% by mass based on the mass of the solid content of the crosslinked resin surface layer, and the dimethylpolysiloxane and the lubricating fine particles are mixed at a mass ratio of 3:7 to 7:3.

General Formula 1

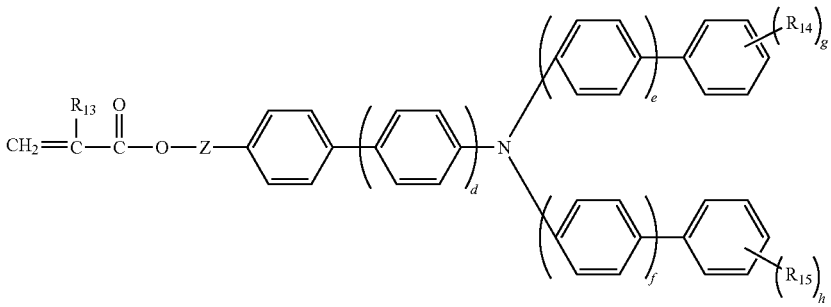

wherein, d, e and f each represents an integer of 0 or 1, $R_{13}$ represents a hydrogen atom or methyl group, $R_{14}$ and $R_{15}$ each represents an alkyl group having 1 to 6 carbon atoms and may be different in the case of a plurality of groups, g and h each represents an integer of 0 to 3, and Z represents a single bond, methylene group, ethylene group, or one of the groups indicated below:

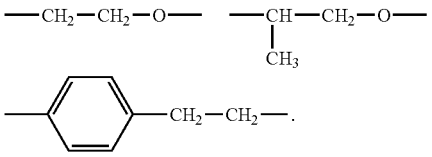

The inventors of the present invention found that the problems can be solved by applying the technology explained above thereby leading to completion of the present invention.

Namely, according to the present invention, an electrophotographic photoconductor, process cartridge and/or electrophotographic apparatus equipped with an electrophoto- <2> The electrophotographic photoconductor according to claim 1, wherein the dimethylpolysiloxane having a radically polymerizable functional group is a modified dimethylpolysiloxane having a radically polymerizable functional group on one end thereof.

<3> The electrophotographic photoconductor according to <1>, wherein the dimethylpolysiloxane having a radically polymerizable functional group is a methacryloyl-modified dimethylpolysiloxane having a radically polymerizable functional group on one end thereof.

<4> The electrophotographic photoconductor according to <1>, wherein the crosslinked resin surface layer further contains a crosslinked monofunctional radically polymerizable compound having a charge transporting structure, and the crosslinked monofunctional radically polymerizable compound is represented by General Formula 1, and is contained at a ratio of 5% by mass to less than 60% by mass based on the mass of the solid content of the crosslinked resin surface layer:

General Formula 1

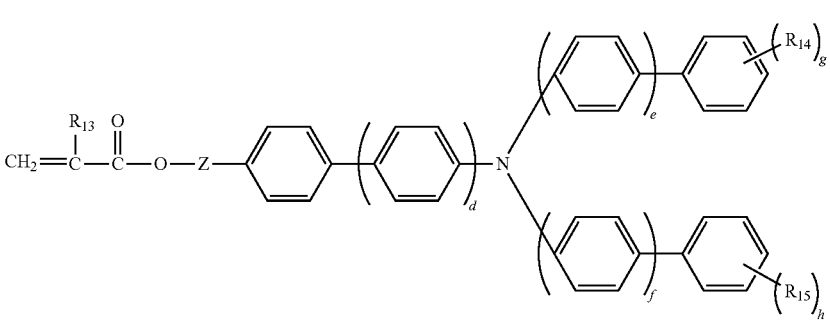

wherein, d, e and f each represents an integer of 0 or 1, $R_{13}$ represents a hydrogen atom or methyl group, $R_{14}$ and $R_{15}$ each represents an alkyl group having 1 to 6 carbon atoms and may be different in the case of a plurality of groups, g and h each represents an integer of 0 to 3, and Z represents a single bond, methylene group, ethylene group, or one of the groups indicated below:

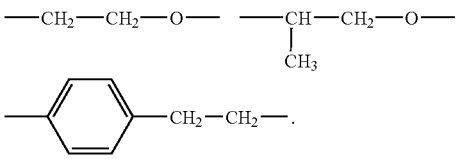

<5> A process cartridge containing the electrophotographic photoconductor according to <1>.

<6> An electrophotographic apparatus containing the electrophotographic photoconductor according to <1>.

<7> The electrophotographic apparatus according to <6>, further containing a charging unit configured to charge the electrophotographic photoconductor for superimposing an AC component.

<8> An electrophotographic photoconductor containing a conductive substrate; a photosensitive layer over the conductive substrate; and a crosslinked resin surface layer over the conductive substrate, wherein the crosslinked resin surface layer contains at least trimethylolpropane triacrylate, a dimethylpolysiloxane having a radically polymerizable functional group, and lubricating fine particles, the lubricating fine particles containing at least an tetrafluoroethylene-perfluoroalkyl vinyl ether copolymer, and wherein the total mass of the dimethylpolysiloxane and the lubricating fine particles is 5% by mass to less than 20% by mass based on the mass of the solid content of the crosslinked resin surface layer, and the dimethylpolysiloxane and the lubricating fine particles are mixed at a mass ratio of 3:7 to 7:3.

<9> The electrophotographic photoconductor according to <8>, wherein the dimethylpolysiloxane having a radically polymerizable functional group is a modified dimethylpolysiloxane having a radically polymerizable functional group on one end thereof.

<10> The electrophotographic photoconductor according to <8>, wherein the crosslinked resin surface layer further contains a crosslinked monofunctional radically polymerizable compound having a charge transporting structure, and the crosslinked monofunctional radically polymerizable compound is represented by General Formula 1, and is contained at a ratio of 5% by mass to less than 60% by mass based on the mass of the solid content of the crosslinked resin surface layer:

General Formula 1

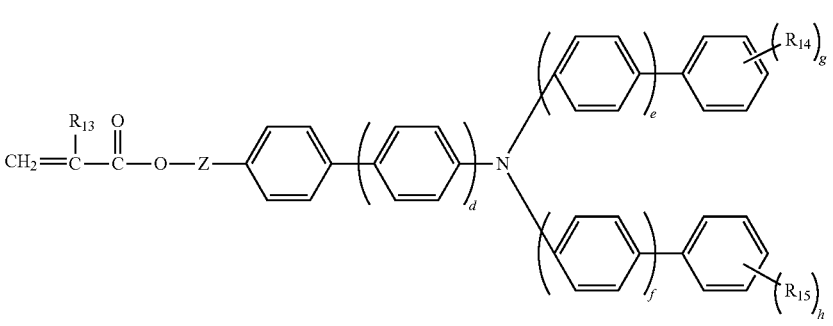

wherein, d, e and f each represents an integer of 0 or 1, $R_{13}$ represents a hydrogen atom or methyl group, $R_{14}$ and $R_{15}$ each represents an alkyl group having 1 to 6 carbon atoms and may be different in the case of a plurality of groups, g and h each represents an integer of 0 to 3, and Z represents a single bond, methylene group, ethylene group, or one of the groups indicated below:

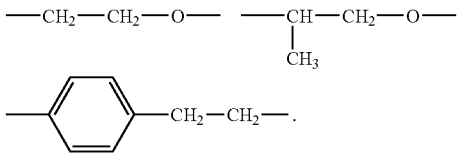

<11> A process cartridge containing the electrophotographic photoconductor according to <8>.

<12> An electrophotographic apparatus containing the electrophotographic photoconductor according to <8>.

<13> An electrophotographic photoconductor containing a conductive substrate; a photosensitive layer over the conductive substrate; and a crosslinked resin surface layer over the conductive substrate, wherein the crosslinked resin surface layer contains at least trimethylolpropane triacrylate, a dimethylpolysiloxane having a radically polymerizable functional group, and lubricating fine particles, the lubricating fine particles containing at least a low molecular polyethylene, and wherein the total mass of the dimethylpolysiloxane and the lubricating fine particles is 5% by mass to less than 20% by mass based on the mass of the solid content of the crosslinked resin surface layer, and the dimethylpolysiloxane and the lubricating fine particles are mixed at a mass ratio of 3:7 to 7:3.

<14> The electrophotographic photoconductor according to <13>, wherein the dimethylpolysiloxane having a radically polymerizable functional group is a modified dimethylpolysiloxane having a radically polymerizable functional group on one end thereof.

<15> The electrophotographic photoconductor according to <13>, wherein the crosslinked resin surface layer further contains a crosslinked monofunctional radically polymerizable compound having a charge transporting structure, and the crosslinkable monofunctional radically polymerizable compound is represented by General Formula 1, and is contained at a ratio of 5% by mass to less than 60% by mass based on the mass of the solid content of the crosslinked resin surface layer:

General Formula 1

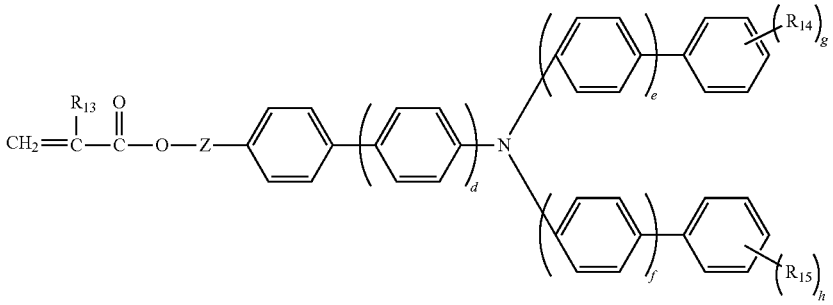

wherein, d, e and f each represents an integer of 0 or 1, $R_{13}$ represents a hydrogen atom or methyl group, $R_{14}$ and $R_{15}$ each represents an alkyl group having 1 to 6 carbon atoms and may be different in the case of a plurality of groups, g and h each represents an integer of 0 to 3, and Z represents a single bond, methylene group, ethylene group, or one of the groups indicated below:

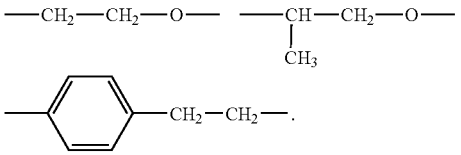

<16>A process cartridge containing the electrophotographic photoconductor according to <13>.

<17>An electrophotographic apparatus containing the electrophotographic photoconductor according to <13>.

The electrophotographic photoconductor of the present invention is an electrophotographic photoconductor having an extremely low increase in friction coefficient and wear while also having superior cleanability even after long-term or large-volume printing. An electrophotographic apparatus using the photoconductor can form an image using a polymerization toner without providing a unit for externally supplying a lubricant to the photoconductor, and has superior practical value.

DETAILED DESCRIPTION OF THE INVENTION

Hereinafter an electrophotographic photoconductor of the present invention will be explained in detail with reference to the drawings.

Figure 1:
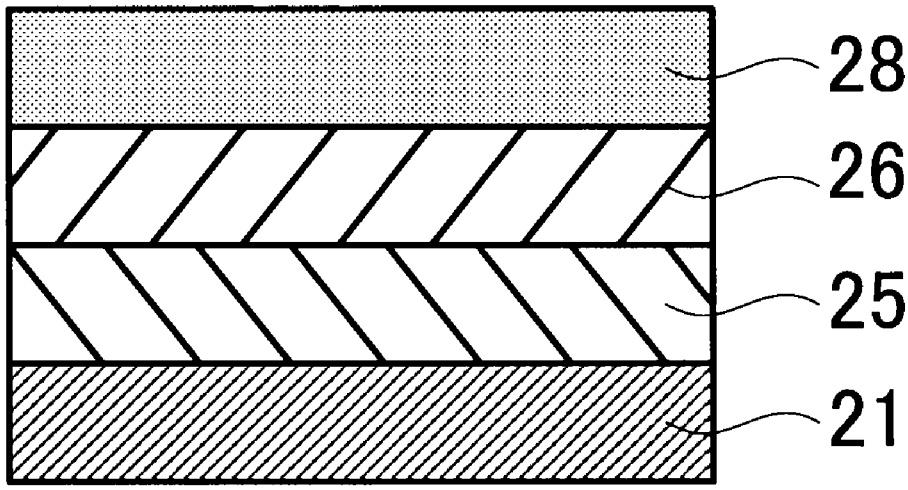
FIG. 1 is a cross-sectional view showing an example of a layer configuration of an electrophotographic photoconductor of the present invention.

FIG. 1 is a cross-sectional view schematically showing an example of an electrophotographic photoconductor having a layer configuration of the present invention. A charge generating layer 25, a charge transporting layer 26 and a crosslinked resin surface layer 28 are provided over a conductive substrate 21.

Figure 2:
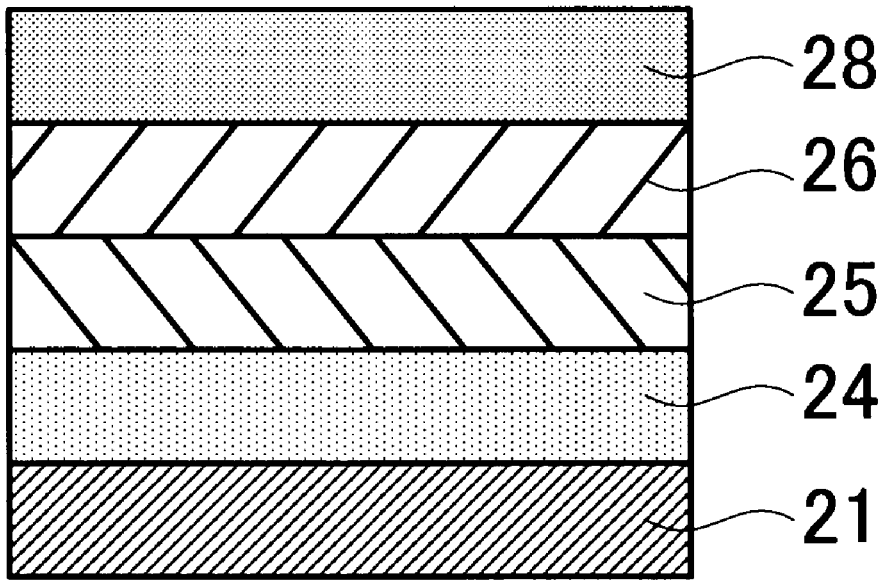
FIG. 2 is a cross-sectional view showing another example of a layer configuration of an electrophotographic photoconductor of the present invention.

FIG. 2 is a cross-sectional view schematically showing an example of an electrophotographic photoconductor having another layer configuration of the present invention. An undercoat layer 24 is provided between the conductive substrate 21 and the charge generating layer 25, and the charge transporting layer 26 and the crosslinked resin surface layer 28 are provided on the charge generating layer 25.

<Conductive Substrate>

A conductive substrate having an electrical conductivity of a volume resistance of $10^{10}$ Ω·cm or less, for example, that formed by coating an oxide of a metal such as aluminum, nickel, chromium, nichrome, copper, silver, gold, platinum or iron, or tin oxide or indium oxide, onto a film-like or cylindrical plastic or paper by vapor deposition or sputtering, or a sheet made of aluminum, aluminum alloy, nickel or stainless steel and a tube and the like in which the aforementioned materials are formed into the shape of a tube by a method such as drawing ironing, impact ironing, extruded ironing, extruded drawing or cutting, followed by cutting, superfinishing and surface treatment such as polishing, can be used for the conductive substrate 21.

<Undercoat Layer>

The undercoat layer 24 can be provided between the conductive substrate and the photosensitive layer in the electrophotographic photoconductor of the present invention. The undercoat layer is provided for the purpose of, for example, improving adhesion, preventing moiré, improving coating ability of the upper layer, and preventing charge injection from the conductive substrate.

The undercoat layer is normally composed mainly of resin. Since a photosensitive layer is normally coated onto the undercoat layer, the resin used for the undercoat layer is preferably a thermosetting resin which is poorly soluble in an organic solvent. In particular, polyurethanes, melamine resins, and alkyd-melamine resins adequately satisfy the above purposes, and are particularly preferable materials. The resin can be used as a coating material after suitably diluting with a solvent such as tetrahydrofuran, cyclohexanone, dioxane, dichloroethane or butanone.

In addition, fine particles of a metal or metal oxide and the like may be added to the undercoat layer to adjust conductivity and prevent moiré. Titanium oxide is particularly preferably used.

The fine particles are dispersed with a ball mill, Attriter or sand mill and the like using a solvent such as tetrahydrofuran, cyclohexanone, dioxane, dichloroethane or butanone followed by mixing the dispersion and resin component to obtain a coating material.

The undercoat layer is formed by deposited onto the substrate by dip coating, spray coating or bead coating and the like followed by heat-curing as necessary.

There are many cases in which the undercoat layer suitably has a thickness of 2 μm to 5 μm. The undercoat layer may have a thickness of less than 3 μm in the case the accumulation of residual potential of the photoconductor is excessively large.

The photosensitive layer in the present invention is preferably a laminated photosensitive layer in which the charge generating layer and charge transporting layer are sequentially laminated.

<Charge Generating Layer>

The charge generating layer 25 accounting for one of the layers of the laminated photoconductor will be explained. The charge generating layer forms a portion of the laminated photosensitive layer and has a function that generates a charge as a result of being exposed to light. The main component of the compounds contained in this layer is a charge generating substance. A binder resin may also be used in the charge generating layer as necessary. Inorganic materials and organic materials can be used for the charge generating substance.

Examples of inorganic materials include crystalline selenium, amorphous selenium, selenium-tellurium, selenium-tellurium-halogen, selenium-arsenic compounds and amorphous silicon. Amorphous silicon in which a dangling bond is terminated with a hydrogen atom or halogen atom, or that doped with a boron atom or phosphor atom, is preferably used for the amorphous silicon.

On the other hand, known materials can be used as organic materials, examples of which include metal phthalocyanines such as titanyl phthalocyanine or chlorogallium phthalocyanine, metal-free phthalocyanines, azulenium salt pigments, squaric acid-methin pigment, symmetrical or asymmetrical azo pigments having a carbazole backbone, symmetrical or asymmetrical azo pigments having a triphenylamine backbone, symmetrical or asymmetrical azo pigments having a fluorenone backbone and perylene pigments. Among these, metal phthalocyanines, symmetrical or asymmetrical azo pigments having a fluorenone backbone, symmetrical or asymmetrical azo pigments having a triphenylamine backbone and perylene pigments have a consistently high quantum efficiency of charge generation, and are preferable as materials used in the present invention. These charge generating substances may be used alone or two or more types may be used as a mixture.

Examples of binder resins used as necessary in the charge generating layer include polyamides, polyurethanes, epoxy resins, polyketones, polycarbonates, polyarylates, silicone resins, acrylic resins, polyvinyl butyrals, polyvinyl formals, polyvinyl ketones, polystyrenes, poly-N-vinyl carbazoles and polyacrylamides. In addition, a polymer charge transporting substance to be described hereinafter can also be used. Among these, polyvinyl butyrals are used frequently and are useful. These binder resins may be used alone or two or more types may be used as a mixture.

Methods for forming the charge generating layer are broadly classified into a vacuum thin film production and casting from a solution dispersion system.

Examples of the vacuum thin film productions include vacuum vapor deposition, glow discharge decomposition, ion plating, sputtering, reactive sputtering and chemical vapor deposition (CVD), and layers composed of the above-mentioned organic materials and inorganic materials can be favorably formed.

In addition, in order to provide a charge generating layer by casting, the above-mentioned inorganic or organic charge generating substance is dispersed with a ball mill, Attriter or sand mill and the like using a solvent such as tetrahydrofuran, cyclohexanone, dioxane, dichloroethane or butanone, together with a binder resin as necessary, followed by suitably diluting the dispersion and coating. Among these solvents, methyl ethyl ketone, tetrahydrofuran and cyclohexanone are preferable since they have a lower burden on the environment than chlorobenzene, dichloromethane, toluene and xylene. Coating can be carried out by dip coating, spray coating or bead coating and the like.

In general, the charge generating layer provided in the manner described above suitably has a thickness of about 0.01 μm to 5 μm normally. When reduction in residual potential or increase of sensitivity are required, these characteristics are frequently improved by increasing the thickness of the charge generating layer. Conversely, this frequently causes poor chargeability, such as retention of accumulated charge or formation of a space charge. In consideration of the balance thereof, the thickness of the charge generating layer is more preferably within the range of 0.05 μm to 2 μm.

In addition, a low molecular mass compound such as an antioxidant, plasticizer, lubricant or ultraviolet absorber, or a leveling agent, to be described hereinafter can also be added to the charge generating layer as necessary. These compounds can be used alone or two or more types can be used as a mixture. The combined use of a low molecular mass compound and a leveling agent frequently results in poor sensitivity. Consequently, the amount of low molecular mass compound used is generally 0.1 phr to 20 phr and preferably 0.1 phr to 10 phr, while the amount of leveling agent used is suitably about 0.001 phr to 0.1 phr.

<Charge Transporting Layer>

The charge transporting layer refers to a portion of the laminated photosensitive layer responsible for providing the function of neutralizing a surface charge of the photoconductor provided by charging accumulation by injecting and transporting a charge formed in the charge generating layer. The main components of the charge transporting layer can be said to be a charge transporting component and a binder component bound therewith.

Examples of materials which can be used for a charge transporting substance include low molecular mass electron transporting substances, hole transporting substances and polymer charge transporting substances.

Examples of electron transporting substances include electron accepting substances such as asymmetrical diphenoquinone derivatives, fluorene derivatives and naphthalimide derivatives.

These electron transporting substances may be used alone or two or more types may be used as a mixture.

Electron donating substances are preferably used as hole transporting substances.

Examples of hole transporting substances include oxazole derivatives, oxadiazole derivatives, imidazole derivatives, triphenylamine derivatives, butadiene derivatives, 9-(p-diethylaminostyrylanthracene), 1,1-bis-(4-dibenzylaminophenyl) propane, styrylanthracene, styrylpyrazoline, phenylhydrazones, α-phenylstilbenes derivatives, thiazole derivatives, triazole derivatives, phenazine derivatives, acridine derivatives, benzofuran derivatives, benzimidazole derivatives and thiophene derivatives.

These hole transporting substances may be used alone or two or more types may be used as a mixture.

In addition, polymer charge transporting substances indicated below can be used, examples of which include polymers having a carbazole ring such as poly-N-vinyl carbazole, polymers having a hydrazone structure exemplified in JP-A No. 57-78402 and the like, polysilylene polymers exemplified in JP-A No. 63-285552 and the like, and aromatic polycarbonates exemplified in General Formula (1) to General Formula (6) of JP-A No. 2001-330973. These polymer charge transporting substances can be used alone or two or more types can be used as a mixture. The compounds exemplified in JP-A No. 2001-330973 in particular are useful because of having favorable performance in terms of electrostatic characteristics.

High molecular charge transporting substances are suitable materials for preventing defective curing of the crosslinkable resin surface layer, because the components contained in the charge transporting layer bled into the crosslinked resin surface layer is reduced during lamination of the crosslinked resin surface layer, as compared with low molecular charge transporting substances. In addition, since the high molecular charge transporting substance is excellent in heat resistance by increasing the molecular mass of the charge transporting substance, it is also advantageous for reducing deterioration caused by the heat for curing when depositing the crosslinkable resin surface layer.

Examples of polymer compounds which can be used as binder components of the charge transporting layer include thermoplastic or thermosetting resins such as polystyrene, polyester, polyvinyl, polyarylate, polycarbonate, acrylic resins, silicone resins, fluorine resins, epoxy resins, melamine resins, urethane resins, phenol resins and alkyd resins. Among these, polystyrene, polyester, polyarylate and polycarbonate are useful since many of them have favorable charge transfer characteristics when they are used as a binder component of the charge transporting layer. In addition, since the crosslinked resin surface layer is laminated on the charge transporting layer, the charge transporting layer does not need mechanical strength which is necessary for the conventional charge transporting layer. Consequently, even materials having high transparency but somewhat low mechanical strength such as polystyrene, which have been considered to be difficult to apply in the related art, can be effectively used as a binder component of the charge transporting layer.

These polymer compounds can be used alone or two or more types can be used as a mixture, or as a copolymer composed of two or more types of raw material monomers thereof, or can be used by copolymerizing with a charge transporting substance.

When an electrically inactive polymer compound is used to modify the charge transporting layer, a polyester such as cardo polymer polyester, polyethylene terephthalate or polyethylene naphthalate having a bulky backbone such as fluorene, a polycarbonate in which the 3,3' sites of a phenol component are alkyl-substituted in a bisphenol polycarbonate such as C-type polycarbonates, a polycarbonate in which a geminal methyl group of bisphenol A is substituted with a long-chain alkyl group having two or more carbon atoms, a polycarbonate having a biphenyl or biphenyl ether backbone, polycaprolactone, a polycarbonate having a long-chain alkyl backbone such as polycaprolactone (described in, for example, JP-A No. 7-292095), acrylic resins, polystyrene and hydrogenated butadiene are effective.

An electrically inactive polymer compound here refers to a polymer compound not containing a chemical structure having photoconductivity such as a triarylamine structure.

When these resins are used in combination with a binder resin such as an additive, the amount added is preferably 50% by mass or less based on the total solid content of the charge transporting layer in consideration of restrictions on light-attenuated sensitivity.

When a low molecular charge transporting substance is used, a suitable amount to be used is about 40 phr to 200 phr and preferably about 70 phr to 100 phr. In addition, when a high molecular charge transporting substance is used, a copolymerized material is preferably used at a ratio of resin component of about 0 parts by mass to 200 parts by mass, and preferably about 80 parts by mass to 150 parts by mass relative to 100 parts by mass of the charge transporting component.

In addition, when two or more charge transporting substances are contained in the charge transporting layer, the difference in ionization potential therebetween is preferably as small as possible, and more specifically, by making the difference in the ionization potential to be 0.10 eV or less, one of the charge transporting substances is able to prevent charge from being trapped by the other charge transporting substances. The relationship between the charge transporting substance contained in the charge transporting layer and the curable charge transporting substance to be described hereinafter is similar to the relationship of the ionization potential, and the difference therebetween is made to be 0.10 eV.

Furthermore, the ionization potential value of a charge transporting substance in the present invention is the value obtained by measuring with a typical method using the AC-1 atmospheric ultraviolet photoelectron analyzer manufactured by Riken Keiki Co., Ltd.

The amount of the charge transporting component is preferably 70 phr or more in order to satisfy high sensitivity. In addition, many monomers and dimers of α-phenylstilbene compounds, benzidine compounds and butadiene compounds, and polymer charge transporting substances having structures thereof in a main chain or side chain, have high charge mobility, and are useful as charge transporting substances.

Examples of dispersion solvents which can be used for preparing a coating liquid for charge transporting layer include ketones such as methyl ethyl ketone, acetone, methyl isobutyl ketone and cyclohexanone, ethers such as dioxane, tetrahydrofuran and ethyl cellosorb, aromatics such as toluene and xylene, halogens such as chlorobenzene and dichloromethane, and esters such as ethyl acetate and butyl acetate. Among these, methyl ethyl ketone, tetrahydrofuran and cyclohexanone are preferable since they have a lower burden on the environment than chlorobenzene, dichloromethane, toluene and xylene. These solvents can be used alone or two or more types can be used by mixing.

The charge transporting layer can be formed by dissolving or dispersing a mixture and/or copolymer mainly composed of a charge transporting component and a binder resin in a suitable solvent, coating and drying. Examples of coating methods that can be employed include dipping, spray coating, ring coating, roll coating, gravure coating, nozzle coating and screen printing.

Since the upper layer of the charge transporting layer is laminated with the crosslinked resin surface layer, the charge transporting layer having this configuration does not need a design of thickening the charge transporting layer in consideration of wear during the course of actual use, and can be thinner.

The film thickness of the charge transporting layer, in consideration of ensuring the required sensitivity and chargeability in terms of practical use, is suitably about 10 μm to 40 μm and more preferably about 15 μm to 30 μm.

In addition, a low molecular compound such as an antioxidant, plasticizer, lubricant or ultraviolet absorber, and a leveling agent, to be described hereinafter can also be added to the charge transporting layer as necessary. These compounds can be used alone or two or more types can be used as a mixture. The combined use of a low molecular compound and a leveling agent frequently results in poor sensitivity. Consequently, the amount of low molecular compound is used generally 0.1 phr to 20 phr and preferably 0.1 phr to 10 phr, while the amount of leveling agent is used suitably about 0.001 phr to 0.1 phr.

<Crosslinked Resin Surface Layer>

The crosslinked resin surface layer (also referred to as crosslinkable resin surface layer) refers to a protective layer deposited on the surface of the photoconductor. This protective layer is provided by coating a coating material followed by depositing a resin having a crosslinkable structure by a polycondensation reaction. Since the resin film has a crosslinkable structure, it has the most robust wear resistance among the layers of the photoconductor. In addition, since a crosslinkable charge transporting material is contained, it has charge transporting properties similar to those of the charge transporting layer.

It is important that the crosslinked resin surface layer at least contain a crosslinked trimethylolpropane triacrylate and a crosslinkable heat-curable or photocurable charge transporting substance. The mixed ratio thereof are substantially the amounts at which these crosslinked products function, and the mixed amount thereof is preferably 10% by mass to less than 90% by mass based on the mass of the total solid content of the crosslinked resin surface layer.

(Radically Polymerizable Material Component)

A compound described in the paragraph [0022] of JP-A No. 2005-115353 is preferably used as the trifunctional or more radical polymerizable monomer not having a charge transporting structure. Trimethylolpropane triacrylate, caprolactone-modified dipentaerythritol hexaacrylate and dipentaerythritol hexaacrylate are particularly preferable. These are available from reagent manufacturers such as Tokyo Chemical Industry Co., Ltd., and for example, the KAYARAD DPCA series and DPHA series manufactured by Nippon Kayaku Co., Ltd. As a result, the wear resistance of the crosslinked film itself is improved and the strength is increased.

An initiator such as Irgacure 184 manufactured by Ciba Specialty Chemicals, Inc. may be added thereto at about 5% by mass to 10% by mass based on the total solid content.

(Silicone Compound Having a Radically Polymerizable Functional Group)

Examples of the silicone compounds having a radically polymerizable functional group of the present invention include, but are not limited to, X-22-164A (molecular mass: 860), X-22-164B (molecular mass: 1,630), X-22-164C (molecular mass: 2,370), X-22-174DX (molecular mass: 4,600), X-24-8201 (molecular mass: 2,100) and X-22-2426 (molecular mass: 12,000) commercially available from Shin-Etsu Chemical Co., Ltd., Silaprene FM-7711 (molecular mass: 1,000) having radically polymerizable functional groups on both ends thereof, Silaprene FM-7721 (molecular mass: 5,000) having radically polymerizable functional groups on both ends thereof, Silaprene FM-7725 (molecular mass: 10,000) having radically polymerizable functional groups on both ends thereof, Silaprene FM-0711 (molecular mass: 1000) having a radically polymerizable functional group on one end thereof, Silaprene FM-0721 (molecular mass: 5,000) having a radically polymerizable functional group on one end thereof, Silaprene FM-0725 (molecular mass: 10,000) having a radically polymerizable functional group on one end thereof, Silaprene TM-0701 (molecular mass: 423) having a radically polymerizable functional group on one end thereof and Silaprene TM-0701T (molecular mass: 423) having a radically polymerizable functional group on one end thereof commercially available from Chisso Corp., and BYK-UV3500, BYK-UV3510 and BYK-UV3570 commercially available from BYK Japan KK.

These reactive silicone compounds may be used alone or two or more types as a mixture. The content of reactive silicone compound is 0.5% by mass to 15% by mass and preferably 1% by mass to 10% by mass based on the solid content of the coating liquid that forms the crosslinked surface layer. When the reaction silicone compound in the present invention is 1.5% by mass or less, the proportion of a lubricant in the crosslinked surface layer is too low, a low surface energy may not be adequately decreased, and thus, favorable cleanability may not be obtained. In addition, when the content of the reactive silicone compound exceeds 14% by mass, it becomes difficult to obtain a homogeneous coated film having a smooth surface, thereby making this disadvantageous.

A dimethylpolysiloxane having a radically polymerizable functional group on one end thereof and a molecular mass of 4,600 or more is advantageous for demonstrating low friction on the surface of the photoconductor.

(Lubricating Fine Particles)

Fluorine resin fine particles, acrylic-silicone copolymer or low molecular mass polyethylene is used as the lubricating fine particles in the present invention, because they are preferably dispersed in a coating containing a dimethylpolysiloxane having a radically polymerizable functional group and trimethylolpropane triacrylate. The particle diameter is preferably 0.05 μm to 1 μm based on the duration and effectiveness of a low friction.

Examples of fluorine resin fine particles used in the present invention include fine particles of polytetrafluoroethylene (PTFE), tetrafluoroethylene-perfluoroalkylvinyl ether copolymer (PFA), tetrafluoroethylene-hexafluoropropylene copolymer (FEP), tetrafluoroethylene-hexafluoropropylene-perfluoroalkylvinyl ether copolymer (EPE), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF) and polyvinyl fluoride (PVF). Among these, polytetrafluoroethylene (PTFE), tetrafluoroethylene-perfluoroalkylvinyl ether copolymer (PFA) and tetrafluoroethylene-hexafluoropropylene copolymer (FEP) are preferable materials in the present invention because of their ability to lower the friction coefficient of the photoconductor surface and the comparatively high ductility of the fluorine resin itself.

In the present invention, the mixed ratio of the fluorine fine particles to the mass of the total solid content of the crosslinked resin surface layer is necessarily 1.5% by mass or more to lower the surface energy as described above because the surface of the photoconductor is needed to maintain a low friction. The mixed ratio of the fluorine resin is preferably about 10% by mass based on the total mass of the surface layer in order to maintain a low friction coefficient of the surface attributable to durability as well, regardless of the characteristics of the electrophotographic apparatus. On the other hand, when the mixed ratio of the fluorine resin is 10% by mass or more, it becomes difficult to form a smooth photoconductor surface during deposition of a protective layer by wet coating. Therefore, the mixed ratio thereof is preferably equal to or less than 10% by mass.

The fluorine resin can be pulverized (ground) and dispersed by a ball mill, vibration mill, sand mill, KD mill, 3-roll mill, pressurized homogenizer, impinging liquid disperser, high-pressure jet dispersion apparatus or ultrasonic dispersion and the like.

In addition, an acrylic-silicone copolymer (also referred to as a silicone-acrylic copolymer) can also be effectively used in the present invention. Preferable examples of acrylic-silicone copolymers include Chaline R-170 and Chaline R-170S commercially available from Nisshin Chemical Industry Co., Ltd. Since these copolymers have a primary particle diameter of 0.2 μm, they can be used without pretreatment.

The average particle diameter of the acrylic-silicone copolymer in the crosslinkable resin can be adjusted by a method of preparing a coating.

For example, the average particle diameter can be adjusted by stirring a dispersion of acrylic-silicone copolymer and coating solvent while heating to 50° C., or by subjecting the coating to high-pressure collision by means of, for example, the Ultimizer system manufactured by Sugino Machine Ltd.

In addition, HI-WAX 100P (a low molecular mass polyethylene having a viscosity-based molecular weight of 900) manufactured by Mitsui Chemicals, Inc. or CERAFLUOR 991 manufactured by BYK-CERA B.V. are preferable for the low molecular polyethylene. These can be pulverized (ground) and dispersed with a ball mill, vibration mill or sand mill and the like in the same manner as pulverizing the fluorine resin.

(Crosslinkable Charge Transporting Material)

The crosslinkable charge transporting material represented by the previously indicated General Formula 1 is advantageously used for the crosslinkable charge transporting material since it is advantageous not only for photoattenuation property and charge property, but also for obtaining a homogeneous cured layer. Exposure with a metal halide lamp is convenient for radical polymerization of the coated layer. The above-mentioned charge transporting materials less absorb unnecessary light that inhibits radical polymerization during exposure, and are advantageous for obtaining a homogeneous film. Since it is important to substantially demonstrate a charge transporting function by mixing this material, the amount to be contained is necessarily 5% by mass or more based on the mass of the total solid content of the crosslinked resin surface layer. The upper limit thereof is preferably less than 60% by mass in consideration of cost and inhibiting poor layer strength.

A material having superior injectability from the underlying charge transporting layer and a high charge transporting capacity is preferable for the curable charge transporting substance. With regard to this, use of a charge transportable monomer used to synthesize a polymer charge transporting substance disclosed in JP-A No. 2001-330973 has a proven track record and is extremely useful. In addition, if the mass (equivalent) per functional group responsible for curing the molecular backbone is excessively small, the content of curing agent in the curable resin surface layer is increased and as a result, the maximum content of the curable charge transporting substance is restricted. In terms of preparation design, a material having the large equivalent is preferable, and more specifically, a material having the equivalent of 200 or more is preferably selected. In particular, use of the above-described compounds represented by General Formula 1 can be said to be rational.

Examples of more preferable compounds represented by General Formula 1 include acrylic acid 4'-(di-p-tolylamino)-biphenyl-4-yl ester, 2-methyl-acrylic acid 4'-(di-p-tolylamino)-biphenyl-4-yl ester, acrylic acid 4'-diphenylamino-biphenyl-4-yl ester and 2-methyl-acrylic acid 4'-diphenylamino-biphenyl-4-yl ester.

Exposure with a metal halide lamp is convenient for radical polymerization of the coated layer. The charge transporting substances of General Formula 1 less absorb unnecessary light that inhibits radical polymerization during exposure, and are advantageous for homogeneous layer deposition. Since it is important to substantially demonstrate a charge transporting function by mixing this material, the amount to be contained is necessarily 5% by mass or more based on the mass of the total solid content of the crosslinked resin surface layer. The upper limit thereof is preferably less than 60% by mass in consideration of cost and inhibiting poor layer strength.

(Production Process)

The dispersion solvent to be used to prepare a coating for the crosslinkable resin surface layer adequately dissolves the monomer is preferred, examples thereof include the previously indicated ethers, aromatics, halogens and esters; cellosorbs such as ethoxyethanol; and propylene glycols such as 1-methoxy-2-propanol. Among these, methyl ethyl ketone, tetrahydrofuran, cyclohexanone and 1-methoxy-2-propanol are preferable since they have a lower burden on the environment than chlorobenzene, dichloromethane, toluene and xylene. These solvents can be used alone or two or more types can be used by mixing.

Examples of methods used to coat the coating for the crosslinkable resin surface layer include dipping, spray coating, ring coating, roll coating, gravure coating, nozzle coating and screen printing. In many cases, a method of applying coating only a necessary amount by a small amount is advantageous in view of environment and costs since the pot life of the coating liquid is not long. Among these methods, spraying coating and ring coating are preferable.

A UV irradiating light source such as a high-pressure mercury lamp or metal halide lamp having an emission wavelength mainly in the ultraviolet light range can be used when depositing the crosslinkable resin surface layer. In addition, a visible light source can also be selected corresponding to the absorption wavelength of the radically polymerizable contents and photopolymerization initiator. The exposure dose is preferably 50 mW/cm$^2$ to 1,000 mW/cm$^2$, and a light exposure dose of less than 50 mW/cm$^2$ needs considerable time for the curing reaction. The reaction proceeds unevenly when the light exposure dose exceeds 1,000 mW/cm$^2$, wrinkles are locally formed in the surface of the crosslinked charge transporting layer or the formation of large numbers of unreacted residues or reaction-termination ends. In addition, rapid crosslinking causes excessively large internal stress, thereby forming cracks and breaks in the layer.

A low molecular compound such as an antioxidant, plasticizer, lubricant or ultraviolet absorber, or a leveling agent, described above for the charge generating layer, or the polymer compounds described above for the charge transporting layer can also be added to the crosslinked resin surface layer as necessary. These compounds can be used alone or two or more types can be used as a mixture. The combined use of a low molecular mass compound and a leveling agent frequently results in poor sensitivity. Consequently, the amount of low molecular compound is used generally 0.1% by mass to 20% by mass and preferably 0.1% by mass to 10% by mass, while the amount of leveling agent is used suitably about 0.1% by mass to 5% by mass, of the total solid content of the coating.

The film thickness of the crosslinked resin surface layer is suitably about 3 μm to 15 μm. The lower limit is the value calculated from the degree of the effects relative to deposition cost, while the upper limit is set based on electrostatic characteristics such as the stability of charge accumulation and light-attenuated sensitivity, and homogeneity of layer quality.

(Embodiment of Electrophotographic Apparatus)

Hereinafter, an electrophotographic apparatus used in the present invention will be explained with reference to the drawings.

Figure 3:
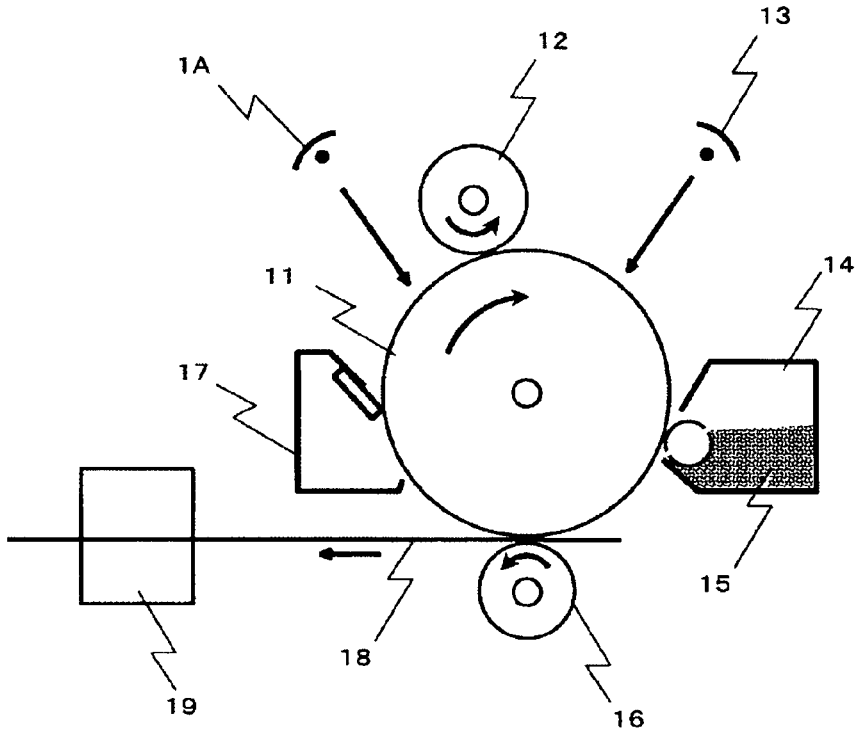
FIG. 3 is a schematic cross-sectional view showing an example of an electrophotographic apparatus of the present invention.

FIG. 3 is a schematic drawing for explaining an electrophotographic apparatus of the present invention, and variations to be described below are also included in the scope of the present invention.

In FIG. 3, the photoconductor 11 is an electrophotographic photoconductor laminated with a crosslinked resin surface layer. Although the photoconductor 11 is shown in the form of a drum, it may also be in the form of a sheet or endless belt.

A charging unit 12 uses a known unit such as a corotron, scorotron, solid-state charger or charging roller. A charging unit arranged in contact with or in close proximity to the photoconductor is preferably used from the viewpoint of reducing power consumption. A charging mechanism arranged in close proximity to the photoconductor having a suitable gap between the photoconductor and surface of the charging unit is particularly preferable for preventing contamination of the charging unit. Although a charger described above can be typically used for a transfer unit 16, which combines the use of a transfer charger and a separation charger is effective.

Examples of light sources used for an exposing unit 13, a charge-eliminating unit 1A and the like include all types of light emitting devices such as a fluorescent lamp, tungsten lamp, halogen lamp, mercury lamp, sodium lamp, light emitting diode (LED), semiconductor laser (LD) or electroluminescence (EL) device. Various types of filters can also be used to irradiate light of only a desired wavelength band, examples of which include a sharp cutoff filter, band pass filter, near infrared cutoff filter, dichroic cutoff filter, interference filter and color temperature conversion filter.

Although a toner 15 developed on the photoconductor by a developing unit 14 is transfer to a printing medium 18 such as printing paper or OHP slide, all of the toner is not transferred and a certain amount of toner remains on the photoconductor. This toner is removed from the photoconductor by a cleaning unit 17. A rubber cleaning blade or a brush such as a fur brush or magfur brush can be used for the cleaning unit.

When the electrophotographic photoconductor is positively (negatively) charged and an image is exposed, a positive (negative) latent electrostatic image is formed on the surface of the photoconductor. If the image is developed with a toner having negative (positive) polarity (charge-detecting fine particles), a positive image is obtained, while if the image is developed with a toner having positive (negative) polarity, a negative image is obtained. A known method can be applied for this developing unit, and a known method can be used for the charge-eliminating unit.

Figure 4:
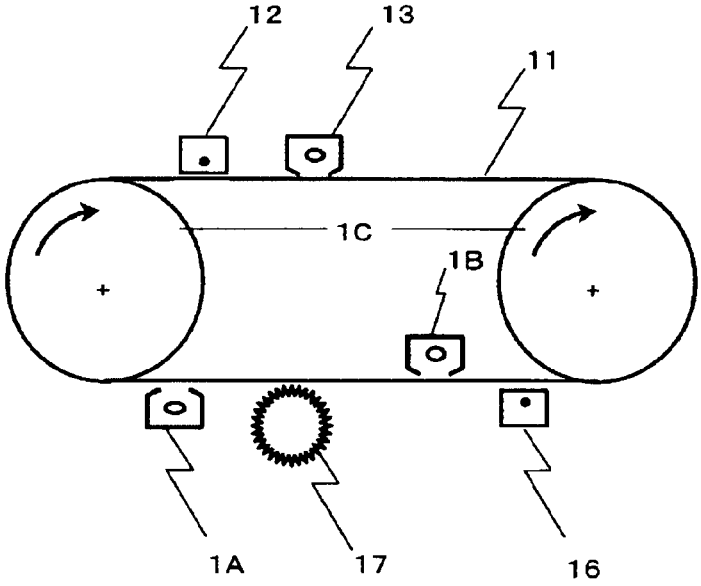
FIG. 4 is a schematic cross-sectional view showing another example of an electrophotographic apparatus of the present invention.

FIG. 4 shows another example of an electrophotographic process according to the present invention.

In FIG. 4, the photoconductor 11 is an electrophotographic photoconductor laminated with a crosslinked resin surface layer. Although the photoconductor 11 is shown in the form of a belt, it may also be in the form of a drum, sheet or endless belt. The photoconductor 11 is driven by a drive unit 1C, and repeatedly undergoes charging by a charging unit 12, image exposure by an exposing unit 13, development (not shown), transfer by a transfer unit 16, pre-cleaning exposure by a pre-cleaning exposing unit 1B, cleaning by a cleaning unit 17 and charge-elimination by a charge-eliminating unit 1A. In FIG. 4, light for pre-cleaning exposure is irradiated from the substrate side of the photoconductor (the substrate is translucent in this case).

The electrophotographic process described above exemplifies an embodiment in the present invention, and other embodiments are naturally also possible. For example, although pre-cleaning exposure is carried out from the substrate side in FIG. 4, it may also be carried out from the photoconductor side, and irradiation of light for image exposure and charge-elimination may be carried out from the substrate side. On the other hand, although light irradiation steps of image exposure, pre-cleaning exposure and charge-elimination exposure are shown, and additionally, pre-transfer exposure, pre-exposure for image exposure and other known light irradiation steps can be provided to irradiate light onto the photoconductor.

Figure 5:
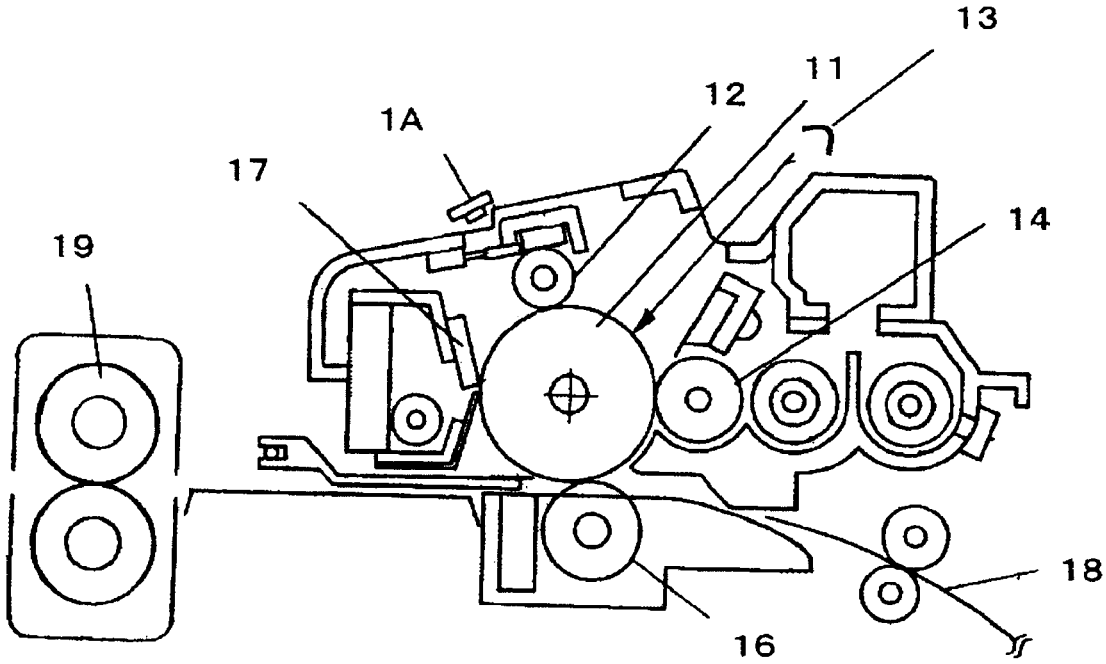
FIG. 5 is a schematic cross-sectional view showing still another example of an electrophotographic apparatus of the present invention.

In addition, although an image forming unit as described above may be permanently built in a photocopier, facsimile machine or printer, it may also be built in these devices in the form of a process cartridge. Although there are many examples of the forms of the process cartridge, a typical example is shown in FIG. 5. Although the photoconductor 11 is shown in the form of a drum, it may also be in the form of a sheet or endless belt.

Figure 6:
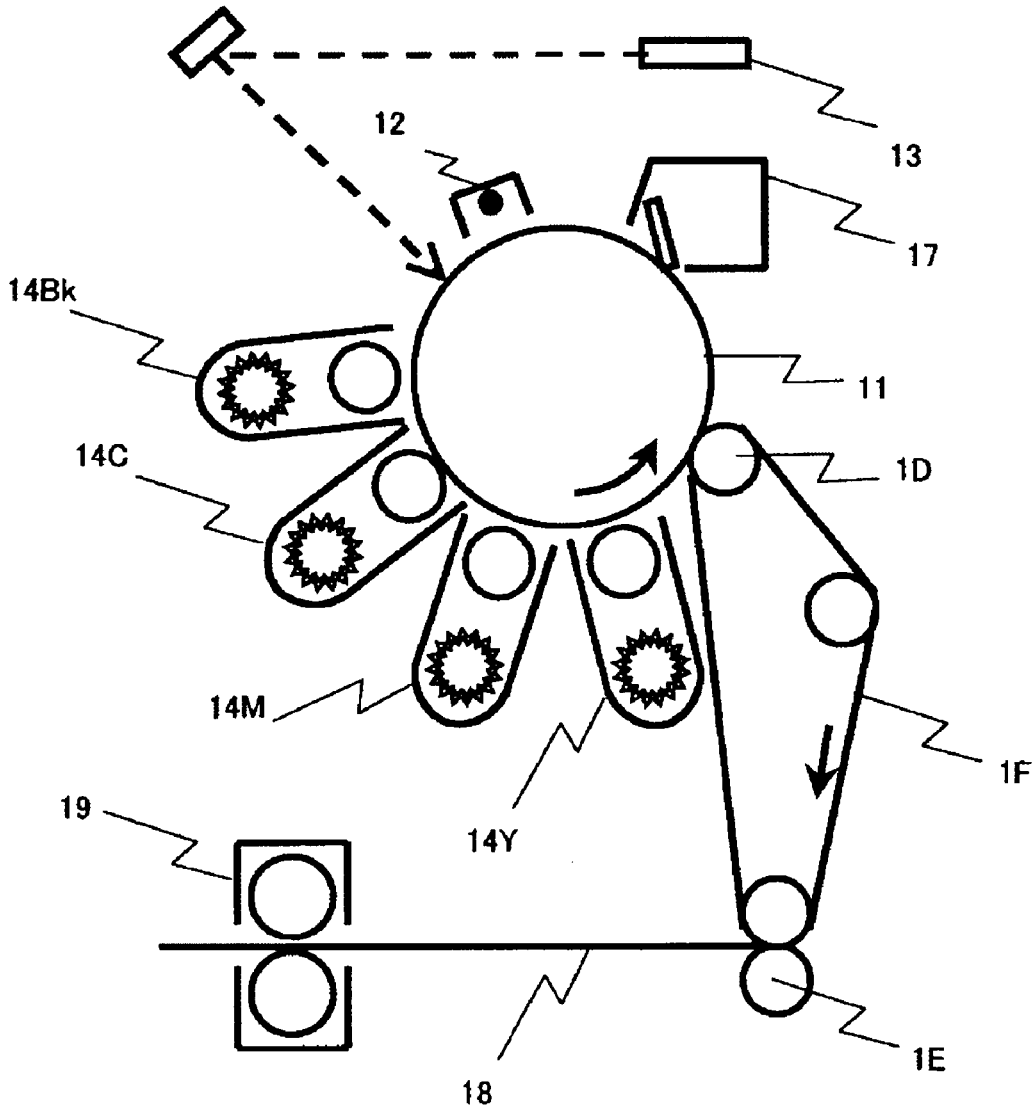
FIG. 6 is a schematic cross-sectional view showing still another example of an electrophotographic apparatus of the present invention.

FIG. 6 shows another example of an electrophotographic apparatus according to the present invention. In this electrophotographic apparatus, a charging unit 12, exposing unit 13, developing units 14Bk, 14C, 14M and 14Y for each color of toner consisting of black (Bk), cyan (C), magenta (M) and yellow (Y), an intermediate transfer unit in the form of an intermediate transfer belt 1F and a cleaning unit 17 are arranged in that order around the photoconductor 11. Here, the suffixes Bk, C, M and Y in the drawing correspond to the above-mentioned toner colors, and suffixes may be suitably added or removed as necessary. The photoconductor 11 is an electrophotographic photoconductor laminated with a crosslinked resin surface layer. Each color of developing unit 14Bk, 14C, 14M and 14Y can be separately and independently controlled, and only the developing unit of the color used to form an image is driven. A toner image formed on the photoconductor 11 is transferred to the intermediate transfer belt 1F by a first transfer unit 1D arranged inside the intermediate transfer belt 1F. The first transfer unit 1D is placed in such a manner as to be able to come into and out of contact with the photoconductor 11 and brings the intermediate transfer belt 1F into contact with the photoconductor 11 only at the time of transfer operation. Images of each color are sequentially formed, and toner images superimposed onto one another on the intermediate transfer belt 1F are transferred onto a printing medium 18 at one time by a second transfer unit 1E and then fixed by a fixing unit 19 so as to form an image. The second transfer unit 1E is also placed in such a manner as to be able to come into and out of contact with the intermediate transfer belt 1F and comes into contact with the intermediate transfer belt 1F only at the time of transfer operation.

In an image forming apparatus based upon a transfer drum system, since toner images of each color are sequentially transferred onto a transfer material electrostatically adsorbed on a transfer drum, there is such a restriction on the transfer material that printing cannot be carried out on a thick paper; whereas, in such an image forming apparatus based upon an intermediate transfer system as shown in FIG. 6, since toner images of each color are superimposed onto one another on the intermediate transfer medium 1F, the image forming apparatus is characterized in that it is free of restrictions on a transfer material. This type of intermediate transfer system can be applied not only to the apparatus shown in FIG. 6, but also to electrophotographic apparatuses shown in the previously described FIG. 3, FIG. 4 and FIG. 5 as well as to the electrophotographic apparatus shown in FIG. 7 to be described below (a specific example of which is shown in FIG. 8).

Figure 7:
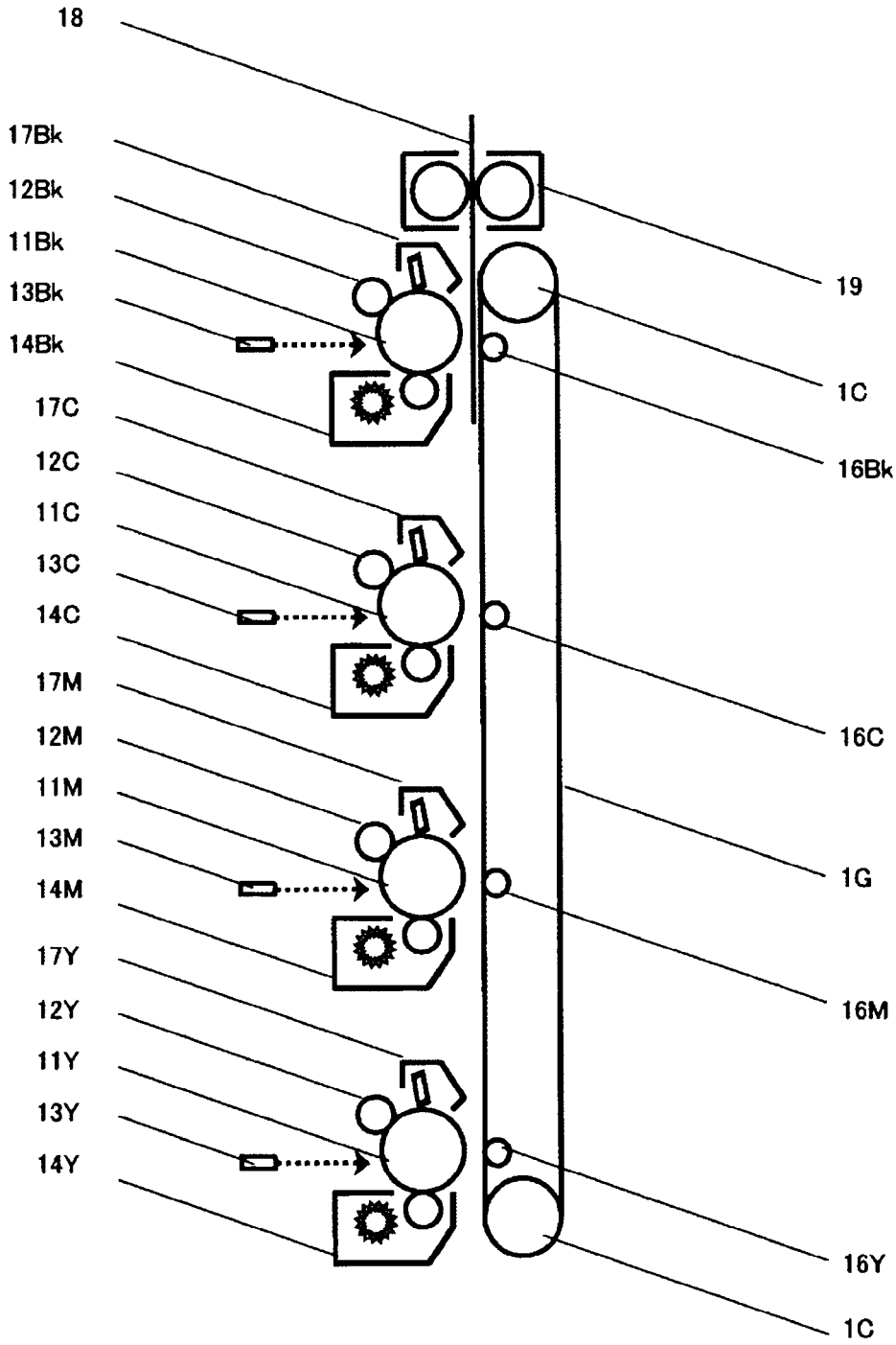
FIG. 7 is a schematic cross-sectional view showing still another example of an electrophotographic apparatus of the present invention.
Figure 8:
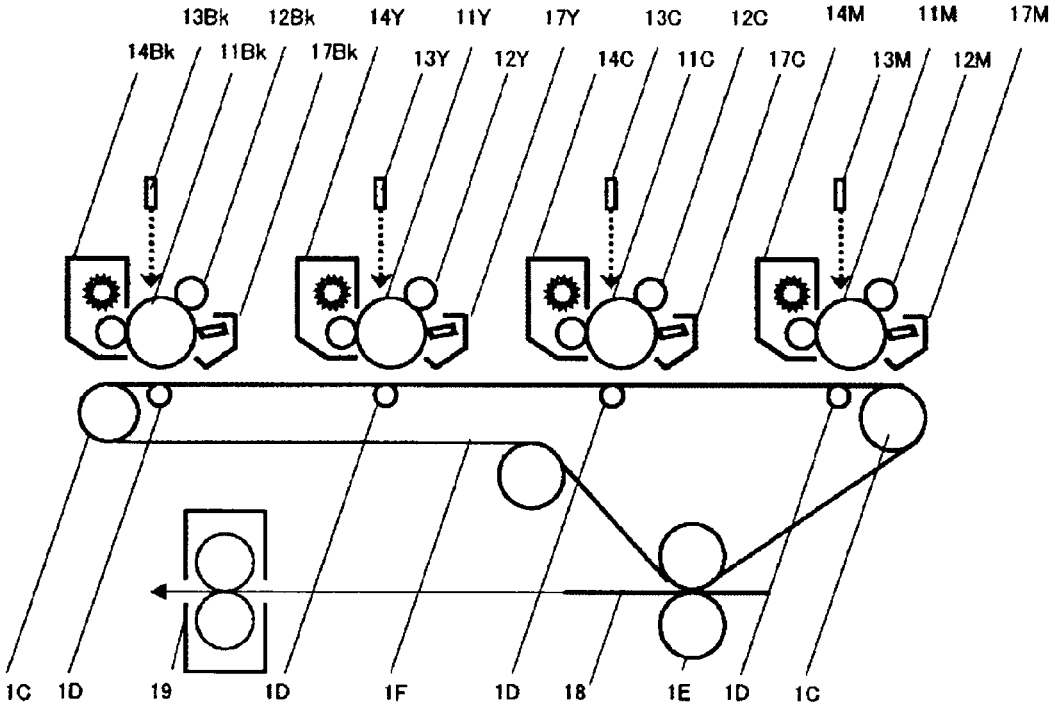
FIG. 8 is a schematic cross-sectional view showing still another example of an electrophotographic apparatus of the present invention.

FIG. 7 shows another example of an electrophotographic apparatus according to the present invention. This electrophotographic apparatus is classified as a type using four colors of toner consisting of yellow (Y), magenta (M), cyan (C) and black (Bk), and image forming units are independently provided for these colors. In addition, photoconductors are provided for each color 11Y, 11M, 11C, 11Bk. The photoconductors 11 used in the electrophotographic apparatus are electrophotographic photoconductors laminated with a crosslinked resin surface layer. A charging unit 12, exposing unit 13, developing unit 14, cleaning unit 17 and the like are arranged around each photoconductor 11Y, 11M, 11C, 11Bk. In addition, a conveyance transfer belt 1G serving as a transfer material bearing member which comes into and out of contact with the transfer positions of the photoconductors 11Y, 11M, 11C and 11Bk linearly disposed is stretched around a pair of drive units 1C. Transfer units 16 are arranged at transfer locations in opposition to each photoconductor 11Y, 11M, 11C, 11Bk with the conveyance transfer belt 1G interposed there between.

Since an electrophotographic apparatus based upon a tandem system as shown in FIG. 7 has a photoconductor 11Y, 11M, 11C, 11Bk for each color, and toner images of each color are sequentially transferred to a printing medium 18 retained on the conveyance transfer belt 1G, full-color images can be output at a much higher speed than a full-color electrophotographic apparatus provided with only a single photoconductor.

EXAMPLES

Hereinafter the present invention will be explained through examples.

At first, measurement methods relating to the present invention will be explained.

(1) Measurement of Layer Thickness

A layer thickness was measured at 1 cm intervals in the lengthwise direction of a photoconductor drum using an eddy current film thickness measuring instrument (Fischer Scope MMS, Fischer Technology, Inc.), and the average value thereof was defined as the thickness of the photosensitive layer.

(2) Measurement of Friction Coefficient

The friction coefficient of the surface of a photoconductor was measured according to the method described in the paragraph [0047] of JP-A No. 2001-201899. That is, a belt-shaped measurement member made of wood-free paper of intermediate thickness, cut along its paper-pressing direction, is first brought in contact with a ¼ circumferential surface of a cylindrical photoconductor. Then, a load of 100 g is applied to one end (lower end) of the measurement member, and a force gauge is connected to the other end. Thereafter, the force gauge is moved at a constant speed, and the scale of the force gauge at the time when the belt has began to move is measured, and then the friction coefficient is calculated by the following equation:

$$\mu s = 2/\pi \times \ln(F/W)$$

where, μs is a static friction coefficient, F is a value read from the force gauge (g) and W is load (100 g).

(3) Measurement of Surface Roughness

The ten-point average roughness (Rz) (JIS B0601; 1982) was measured for the surface of a drum-shaped photoconductor using the Surfcom a tracer-type surface roughness meter (Tokyo Seimitsu Co., Ltd.) attached with the E-DT-S02A pickup (manufactured by Tokyo Seimitsu Co., Ltd.)

(4) Measurement of Escape Degree

An explanation is first provided of escape degree as used in the present invention.

Escape degree as referred to in the present invention refers to the amount of toner that escapes being rubbed off by a cleaning blade during a process in which toner adhered to a photoconductor is captured with a cleaning blade. Toner that has failed to be rubbed off was captured by installing a piece of felt having a white background measuring 8 mm×310 mm and having a thickness of 1 mm (Tsuchiya Co., Ltd., to be referred to as an escaped toner catcher) downstream from the cleaning blade and upstream from an opening of the a developing device, and causing the felt to contact the photoconductor.

The degree of contamination of the felt was converted to digital data with an image scanner, and the contrast (image density) was classified to one of five levels. The area of each concentration divided into the five levels (image area fraction) was determined and escape degree was calculated from Equation 1 shown below.

$$\text{Escape degree: } T = \Sigma(\text{image area fraction}) \times (\text{image density}) \qquad \text{Equation 1}$$

Here, since the image density is naturally nearly proportional to the minute amount of toner present per unit area, if each area fraction is made to reflect each specific image density (5 levels) and the five results obtained are added, a value is obtained that closely corresponds to the total amount of toner that has escaped. Although it may be possible to capture the escaped toner and measure the mass thereof, the degree of image smear is more closely correlated with optical density attributable to the escaped toner than the mass of the escaped toner. The terms "nearly proportional" and "closely corresponds" used above are used in this sense, and are the result of, for example, the total mass of the escaped toner not reflecting the particle size distribution of the toner particles constituting the toner. Furthermore, image area fraction and image density were measured using the Pseudo-Color command of Image Pro Plus Ver. 3.0 by Media Cybernetics Inc. Escape degree was defined as having a minimum value of 0 and maximum value of 500.

Figure 9:
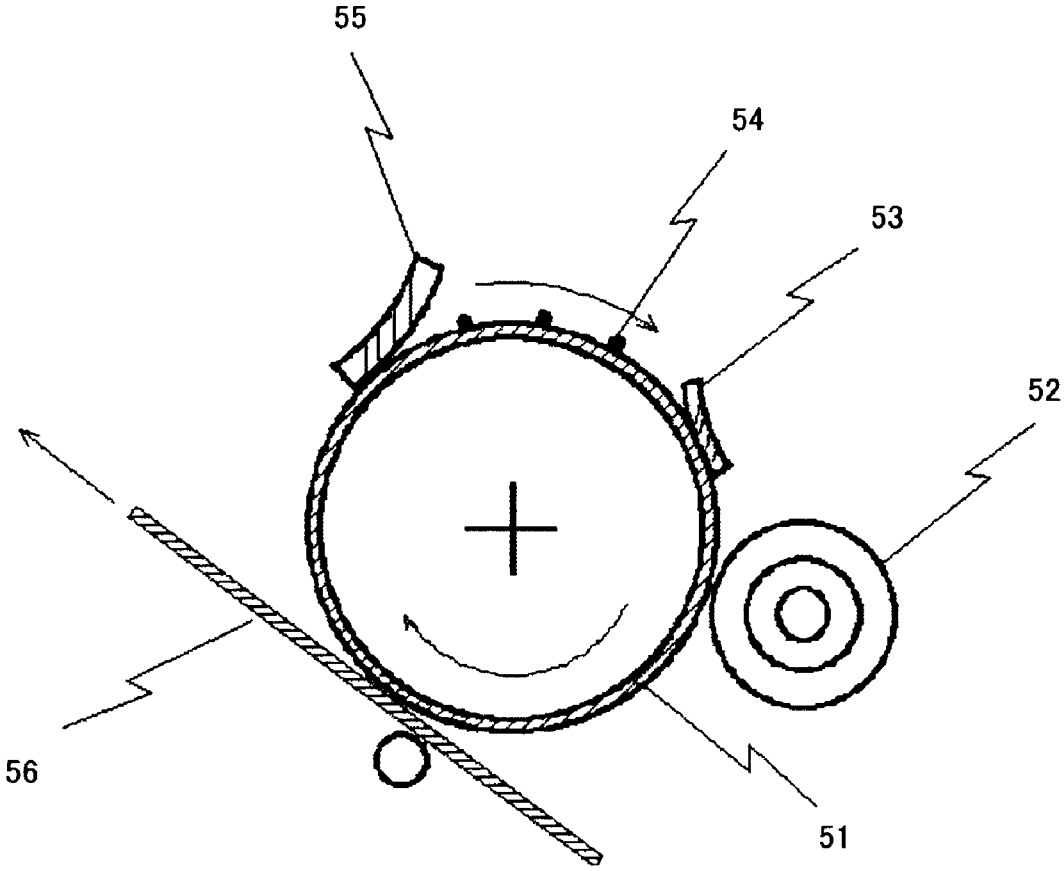
FIG. 9 is a drawing of an example representing the layout around a photoconductor for measuring escape degree.

In the test, a photoconductor 51, cleaning blade 55, developing unit 52 and escaped toner catcher 53 configured to catch escaped toner 54 were attached to an electrophotographic apparatus to have a layout as shown in FIG. 9, and the amount of toner supplied from the developing device to the photoconductor was made to be uniform by adjusting the charging potential, developing bias voltage and dose of writing light. Fifty sheets of A4-size images 56 were then continuously printed out at an image density of 5%. The escaped toner catcher was subsequently recovered and the escape degree was calculated using the method described above.

When this escape degree was excessively high, there was increased susceptibility to filming of the photoconductor surface. On the other hand, when the escape degree was excessively low, the cleaning blade was pulled along with the rotation of the photoconductor and as a result, the blade ends up simply passing over the photoconductor causing an excessive amount of toner to escape. The escape degree preferably was 5 to 50, allowing to avoid line-like toner filming. Moreover, when the escape degree was 5 to 30, high-quality printed images were obtained substantially without background smear.

Actual measurements were carried out according to the following procedure. Namely, the cleaning brush, charging roller cleaner and zinc stearate rods were removed from the photoconductor assembly of an Imagio Neo C455 manufactured by Ricoh Company, Ltd. and the photoconductor assembly was used to measure escape degree. The installed site was the black developing station. The DC bias of the bias voltage applied to the charging roller of the Imagio Neo C455 wad adjusted so that the charging potential of the photoconductor was −700 V. Next, the dose of writing light was adjusted so that the potential of the exposing unit was −250 V. Under this condition, a solid pattern was then written while changing to various levels of developing bias. Toner supplied to the photoconductor prior to transfer was captured with transparent pressure-sensitive adhesive tape (Printac C, Nitto Chemical Industry Co., Ltd.), the image density of the tape used to capture the toner was measured with a reflection spectral densitometer (X-RITE 939, Canon I-Tech Inc.), and this density was changed to a developing bias of 1.0.

Next, the escaped toner catcher (felt measuring 8 mm×310 mm and having a thickness of 1 mm, Tsuchiya Co., Ltd.) was laminated onto the upper end of the opening of the developing unit with 2 mm thick sponge tape (Scotch Tape 4016, Sumitomo 3M Ltd.). This was then attached to the main body.

A new cleaning blade originally provided with the Imagio Neo C455 was attached for the cleaning blade, a cleaned photoconductor drum was mounted, and 50 sheets of A4-size test pattern images were continuously printed out in an environment at 23° C. and 55% RH and image density of 5% onto copy paper (My Paper A4, NBS Ricoh Company, Ltd.). A genuine polymerization toner was used for the toner.

After printing, the escaped toner catcher was recovered and the image was converted to digital data using an image scanner (ES-8500, Seiko Epson Corporation). The scanner read the image data under the condition of a zoom level of 100%, color correction by a color driver of 1.0, output of 800 dpi, photographic output of 800 dpi, using an unsharp mask, intermediate setting and 8-bit gray.

The image density and area fraction thereof of the escaped toner catcher were calculated using Image Pro Plus Ver. 3.0 available from Media Cybernetics Inc. with the pseudo-color command under the condition of an upper limit of 210, lower limit of 310 and 5 levels. Then, these were totaled to obtain the escape degree.

(5) Image Evaluation by Background Smear

Copy images consisting of five layers of solid copy paper (TYPE 6200, A3, Ricoh Company, Ltd.) were output and background smear was evaluated to one of five levels.

5: Extremely good
4: Good
3: Acceptable
2: Slightly dark impression but acceptable in practical use
1: Dark impression

Example 1

A coating liquid for undercoat layer, coating liquid for charge generating layer and coating liquid for charge transporting layer having the compositions indicated below were sequentially coated and dried on an aluminum drum having a wall thickness of 0.8 mm, length of 340 mm and outer diameter of 30 mm to form a 3.5 μm-thick undercoat layer, 0.2 μm-thick charge generating layer and 19 μm-thick charge transporting layer. After spray coating a coating liquid for crosslinkable resin surface layer having the composition indicated below thereon, the drum was placed at a distance of 120 mm from a UV curing lamp followed by carrying out UV curing while rotating the drum. The luminosity of the UV curing lamp at this position was 600 mW/cm$^2$ (measured value obtained with the UIT-150 integrating ultraviolet photometer by Ushio Inc.). In addition, the drum rotating speed was 25 rpm. During UV curing, a rod-shaped metal block was contained inside the aluminum drum. In addition, UV curing was carried out by repeating cycles consisting of exposing for 30 seconds and pausing for 120 seconds for a total of 7 minutes of exposure. Following UV curing, the aluminum drum was dried by heating for 30 minutes at 130° C. As a result, an electrophotographic photoconductor was obtained provided with a 4 μm-thick crosslinked resin surface layer.

[Coating Liquid for Undercoat Layer]

| | |
|---|---|
| Alkyd resin solution (Beccolite M6401-50, Dainippon Ink & Chemicals, Inc.) | 12 parts by mass |
| Melamine resin solution (Super Beccamin G-821-60, Dainippon Ink & Chemicals, Inc.) | 8 parts by mass |
| Titanium oxide (CR-EL, Ishihara Sangyo Kaisha, Ltd.) | 40 parts by mass |
| Methyl ethyl ketone | 200 parts by mass |

[Coating Liquid for Charge Generating Layer]

| | |
|---|---|
| Bisazo pigment having the structure shown below (Ricoh Company, Ltd.) | 5 parts by mass |

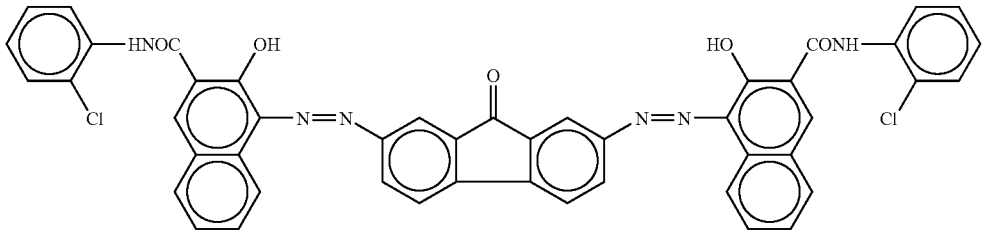

| | |
|---|---|
| Polyvinyl butyral (XYHL, UCC Co., Ltd.) | 1 part by mass |
| Cyclohexanone | 200 parts by mass |
| Methyl ethyl ketone | 80 parts by mass |

[Coating Liquid for Charge Transporting Layer]

| | |
|---|---|
| Z-type polycarbonate (Panlite TS-2050, Teijin Chemicals Ltd.) | 10 parts by mass |
| Low molecular charge transporting substance having the structure shown below | 7 parts by mass |

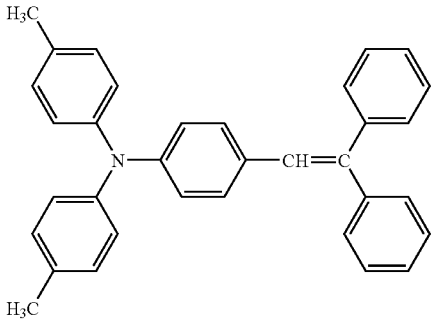

-continued

| | |
|---|---|
| Tetrahydrofuran | 100 parts by mass |
| 1% silicone oil (KF50-100CS, Shin-Etsu Chemical Co., Ltd.) | |
| Tetrahydrofuran solution | 1 part by mass |

[Coating Liquid for Crosslinkable Resin Surface Layer]

| | |
|---|---|
| Crosslinkable charge transporting substance having the structure indicated below | 40 parts by mass |

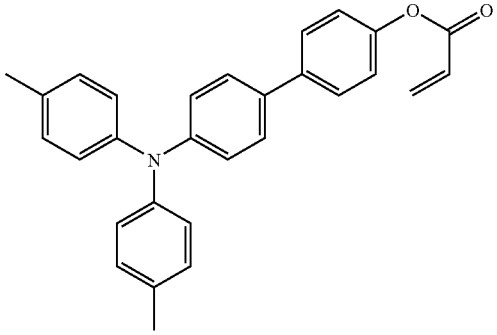

| | |
|---|---|
| (molecular mass/number of functional groups) = 419.53 | |
| Trimethylolpropane triacrylate (KAYARAD TMPTA, Nippon Kayaku Co., Ltd.) | 60 parts by mass |
| Mixture of acrylic group-containing polyester-modified polydimethylsiloxane and propoxy-modified-2-neopentyl glycol diacrylate (BYK-UV3570, BYK Additives & Instruments) | 0.1 parts by mass |
| 1-hydroxycyclohexyl phenyl ketone (Irgacure 184, Ciba Specialty Chemicals, Inc.) | 5 parts by mass |

-continued

| | |
|---|---|
| Methacryloyl-modified dimethylpolysiloxane having radically polymerizable functional groups on both ends thereof (X-22-164C, Shin-Etsu Chemical Co., Ltd.) | 13.0 parts by mass |
| Acrylic-silicone copolymer, primary particle diameter of 0.2 μm (Chaline R-170S, Nisshin Chemical Industry Co., Ltd.) | 13.0 parts by mass |
| Tetrahydrofuran | 400 parts by mass |

Example 2

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 2.0 parts by mass, and changing the amount of the acrylic-silicone copolymer (Chaline R-170S, Nisshin Chemical Industry Co., Ltd.) from 13.0 parts by mass to 4.0 parts by mass.

Example 3

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 7.0 parts by mass, and changing the amount of the acrylic-silicone copolymer (Chaline R-170S, Nisshin Chemical Industry Co., Ltd.) from 13.0 parts by mass to 7.0 parts by mass.

Example 4

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 14.0 parts by mass, and changing the amount of the acrylic-silicone copolymer (Chaline R-170S, Nisshin Chemical Industry Co., Ltd.) from 13.0 parts by mass to 6.0 parts by mass.

Example 5

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 10.0 parts by mass, and changing the amount of the acrylic-silicone copolymer (Chaline R-170S, Nisshin Chemical Industry Co., Ltd.) from 13.0 parts by mass to 10.0 parts by mass.

Example 6

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 6.0 parts by mass, and changing the amount of the acrylic-silicone copolymer (Chaline R-170S, Nisshin Chemical Industry Co., Ltd.) from 13.0 parts by mass to 14.0 parts by mass.

Comparative Example 1

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 30.0 parts by mass, and eliminating the 13.0 parts by mass of the acrylic-silicone copolymer (Chaline R-170S, Nisshin Chemical Industry Co., Ltd.).

Comparative Example 2

An electrophotographic photoconductor was produced in the same manner as in Example 1 with the exception of eliminating methacryloyl-modified dimethylpolysiloxane having radically polymerizable functional groups on both ends thereof (X-22-164C, Shin-Etsu Chemical Co., Ltd.) of the crosslinkable resin surface layer of Example 1, and changing the amount of the acrylic-silicone copolymer (Chaline R-170S, Nisshin Chemical Industry Co., Ltd.) from 13.0 parts by mass to 30.0 parts by mass.

Comparative Example 3

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 2.0 parts by mass, and changing the amount of the acrylic-silicone copolymer (Chaline R-170S, Nisshin Chemical Industry Co., Ltd.) from 13.0 parts by mass to 2.0 parts by mass.

Comparative Example 4

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 18.0 parts by mass, and changing the amount of the acrylic-silicone copolymer (Chaline R-170S, Nisshin Chemical Industry Co., Ltd.) from 13.0 parts by mass to 12.0 parts by mass.

Comparative Example 5

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 16.0 parts by mass, and changing the amount of the acrylic-silicone copolymer (Chaline R-170S, Nisshin Chemical Industry Co., Ltd.) from 13.0 parts by mass to 4.0 parts by mass.

Comparative Example 6

An electrophotographic photoconductor was produced in the same manner as in Example 1 with the exception of changing the amount of the methacryloyl-modified dimethylpolysiloxane having radically polymerizable functional groups on both ends thereof (X-22-164C, Shin-Etsu Chemical Co., Ltd.) of the crosslinkable resin surface layer of Example 1 from 13.0 parts by mass to 4.0 parts by mass, and changing the amount of the acrylic-silicone copolymer (Chaline R-170S, Nisshin Chemical Industry Co., Ltd.) from 13.0 parts by mass to 16.0 parts by mass.

After preparing the electrophotographic photoconductors of Examples 1 to 6 and Comparative Examples 1 to 6 produced in the manner described above for mounting, they were mounted in a black developing station of an electrophotographic apparatus (Imagio Neo C455, Ricoh Company, Ltd.) followed by continuously printing a total of 250,000 sheets, under the condition of printing out 5 sheets at a time of a half-tone pattern having a pixel density of 600 dpi×600 dpi depicting 4 dots×4 dots in an 8×8 matrix, onto a copy paper (My Paper A4, NBS Ricoh Company, Ltd.). All of the zinc stearate rods were removed from the photoconductor assembly.

A spring for applying a load provided on the cleaning blade was changed to an SUS spring having a spring load of 0.40 N/mm, a free length of 14 mm and an inner diameter of 5 mm.

Genuine products originally provided with the Imagio Neo C455 were used for the toner and developer.

A genuine product was used for the photoconductor unit. A peak-to-peak voltage of 1.5 kV and frequency of 0.9 kHz were selected for the AC components of the voltage applied to the charging roller. In addition, a bias voltage was set for the DC component so that the charging potential of the photoconductor at the start of test was −700 V, and test was carried out under the charging condition until the test was completed. In addition, the developing bias voltage was set to −500 V. Furthermore, a charge-eliminating unit was not provided in the apparatus. In addition, test was carried out by changing to an unused genuine cleaning unit for every 50,000 sheets printed. Following completion of test, a color test chart was copied and printed onto Type 6200 A3 plain PPC paper. The test environment was at 24° C. and 54% RH.

The results of evaluating images after the test was completed on Examples 1 to 6 and Comparative Examples 1 to 6 are shown in Table 1 below along with the values for escape degree.

TABLE 1

| | Image Evaluation | Escape degree |
|---|---|---|
| Example 1 | 3 | 90 |
| Example 2 | 2 | 115 |
| Example 3 | 2 | 115 |
| Example 4 | 3 | 80 |
| Example 5 | 3 | 80 |
| Example 6 | 3 | 80 |
| Comparative Example 1 | 1 | 200 |
| Comparative Example 2 | 1 | 180 |
| Comparative Example 3 | 1 | 160 |
| Comparative Example 4 | 1 | 160 |
| Comparative Example 5 | 1 | 135 |
| Comparative Example 6 | 1 | 120 |

Examples 1 to 6 were photoconductors, and these photoconductors inhibited background smear in the margins more than Comparative Examples 1 to 6. The values for escape degree could also be seen to be inhibited more than the comparative examples.

Example 7

An electrophotographic photoconductor was obtained in the same manner as in Example 5 with the exception changing the 10.0 parts by mass of the acrylic-silicone copolymer (Chaline R-170S, Nisshin Chemical Industry Co., Ltd.) of the crosslinkable resin surface layer in Example 5 to 10.0 parts by mass of a polyethylene wax (CERAFLUOR 991, BYK-CERA B.V.).

A mill base obtained by adding 100 g of a zirconia ball medium having a diameter of 5 mm, 9.5 g of tetrahydrofuran and 0.5 g of polyethylene wax to a 50 ml mayonnaise bottle followed by applying vibrations for 2 hours at a dispersion strength of 1,600 rpm using a vibration shaker manufactured by ICA A.G. was used for the polyethylene wax. The average particle diameter of the dispersion was 2.8 μm.

Example 8

An electrophotographic photoconductor was obtained in the same manner as in Example 5 with the exception of changing the 10.0 parts by mass of the methacryloyl-modified dimethylpolysiloxane having radically polymerizable functional groups on both ends thereof (X-22-164C, Shin-Etsu Chemical Co., Ltd.) of the crosslinkable resin surface layer in Example 5 to a methacryloyl-modified dimethylpolysiloxane having a radically polymerizable functional group on one end thereof (viscosity: 60 $mm^2/s$, functional group equivalent: 4,600, X-22-174DX, Shin-Etsu Chemical Co., Ltd.), and changing the 10.0 parts by mass of the acrylic-silicone copolymer (Chaline R-170S, Nisshin Chemical Industry Co., Ltd.) to 10.0 parts by mass of a polyethylene wax (CERAFLUOR 991, BYK-CERA B.V.). A polyethylene wax prepared in the same manner as in Example 7 was used for the polyethylene wax.

Example 9

An electrophotographic photoconductor was obtained in the same manner as in Example 5 with the exception of changing the 10.0 parts by mass of the methacryloyl-modified dimethylpolysiloxane having radically polymerizable functional groups on both ends thereof (X-22-164C, Shin-Etsu Chemical Co., Ltd.) of the crosslinkable resin surface layer in Example 5 to a methacryloyl-modified dimethylpolysiloxane having radically polymerizable functional groups on both ends thereof (X-22-164B Shin-Etsu Chemical Co., Ltd.), and changing the 10.0 parts of the acrylic-silicone copolymer (Chaline R-170S, Nisshin Chemical Industry Co., Ltd.) to 10.0 parts by mass of a polyethylene wax (CERAFLUOR 991, BYK-CERA B.V.). A polyethylene wax prepared in the same manner as in Example 7 was used for the polyethylene wax.

Comparative Example 7

An electrophotographic photoconductor was obtained in the same manner as in Example 5 with the exception of eliminating the 10.0 parts by mass of the methacryloyl-modified dimethylpolysiloxane having radically polymerizable functional groups on both ends thereof (X-22-164C, Shin-Etsu Chemical Co., Ltd.) of the crosslinkable resin surface layer in Example 5 and the 10.0 parts by mass of the acrylic-silicone copolymer (Chaline R-170S, Nisshin Chemical Industry Co., Ltd.).

After preparing the electrophotographic photoconductors of Examples 7 to 9 and Comparative Example 7 produced in the manner described above for mounting, they were mounted in a black developing station of an electrophotographic apparatus (Imagio Neo C455, Ricoh Company, Ltd.), followed by continuously printing a total of 5,000 sheets, under the condition of printing out 5 sheets at a time of a half-tone pattern having a pixel density of 600 dpi×600 dpi depicting 4 dots×4 dots in an 8×8 matrix, onto a copy paper (My Paper A4, NBS Ricoh Company, Ltd.). All of the zinc stearate rods were removed from the photoconductor assembly.

A spring for applying a load provided on the cleaning blade was changed to an SUS spring having a spring load of 0.60 N/mm, a free length of 14 mm and an inner diameter of 5 mm.

Genuine products originally provided with the Imagio Neo C455 were used for the toner and developer.

A genuine product was used for the photoconductor unit. A peak-to-peak voltage of 1.5 kV and frequency of 0.9 kHz were selected for the AC components of the voltage applied to the charging roller. In addition, a bias voltage was set for the DC component so that the charging potential of the photoconductor at the start of test was −700 V, and test was carried out under the charging condition until the test was completed. In addition, the developing bias voltage was set to −500 V. Furthermore, a charge-eliminating unit was not provided in the apparatus. In addition, test was carried out after changing to an unused genuine cleaning unit. Following completion of test, a color test chart was copied and printed onto Type 6200 A3 plain PPC paper. The test environment was at 23° C. and 55% RH.

The friction coefficients and escape degrees were measured for Examples 7 to 9 and Comparative Example 7 after the test was completed.

TABLE 2

| | Friction coefficient | Escape degree |
|---|---|---|
| Example 7 | 0.37 | 56 |
| Example 8 | 0.26 | 30 |
| Example 9 | 0.39 | 59 |
| Comparative Example 7 | 0.59 | 140 |

Organic photoconductors for electrophotography frequently demonstrate a rapid increase in friction coefficient soon after the start of use after which the friction coefficient changes gradually. The test results shown in Table 2 indicate results obtained after printing 5,000 sheets and were measured when the change in friction coefficient of the photoconductor surface was large.

Example 8, in which the radically polymerizable dimethylpolysiloxane is modified with an acryloyloxy group on one end, demonstrated a lower friction coefficient than the other photoconductors. A correspondingly low escape degree was also determined to be obtained. In Comparative Example 7, the photoconductor easily adhered to the cleaning blade and a rubbing noise could be heard. Since the noise was not heard for the other photoconductors, the photoconductors of the present invention were able to be evaluated as also having the effect of being able to prevent this unpleasant rubbing noise.

Example 10

An electrophotographic photoconductor was obtained in the same manner as in Example 5 with the exception of the acrylic-silicone copolymer (Chaline R-170S, Nisshin Chemical Industry Co., Ltd.) having an average particle diameter of 0.03 μm in the crosslinkable resin surface layer.

A tetrahydrofuran dispersion was prepared from the acrylic-silicone copolymer (Chaline R-170S, Nisshin Chemical Industry Co., Ltd.) in which the concentration of the solid content was 5% by mass followed by refluxing at 50° C. The average particle diameter of particles present in the layer was able to be controlled by the degree of this treatment.

In addition, an average particle diameter was obtained from image data from a cross-sectional TEM micrograph of the crosslinked resin surface layer using Image Pro Plus Ver. 3.0 by Media Cybernetics Inc.

Example 11

An electrophotographic photoconductor was obtained in the same manner as in Example 5 with the exception of the acrylic-silicone copolymer (Chaline R-170S, Nisshin Chemical Industry Co., Ltd.) having an average particle diameter of 0.05 μm in the crosslinkable resin surface layer.

Example 12

An electrophotographic photoconductor was obtained in the same manner as in Example 5 with the exception of the acrylic-silicone copolymer (Chaline R-170S, Nisshin Chemical Industry Co., Ltd.) having an average particle diameter of 0.10 μm in the crosslinkable resin surface layer.

Example 13

An electrophotographic photoconductor was obtained in the same manner as in Example 5 with the exception of the acrylic-silicone copolymer (Chaline R-170S, Nisshin Chemical Industry Co., Ltd.) having an average particle diameter of 0.50 μm in the crosslinkable resin surface layer.

Example 14

An electrophotographic photoconductor was obtained in the same manner as in Example 5 with the exception of the acrylic-silicone copolymer (Chaline R-170S, Nisshin Chemical Industry Co., Ltd.) having an average particle diameter of 1.0 μm in the crosslinkable resin surface layer.

Example 15

An electrophotographic photoconductor was obtained in the same manner as in Example 5 with the exception of the acrylic-silicone copolymer (Chaline R-170S, Nisshin Chemical Industry Co., Ltd.) having an average particle diameter of 1.2 μm in the crosslinkable resin surface layer.

After preparing the electrophotographic photoconductors of Examples 10 to 15 produced in the manner described above for mounting, they were mounted in a black developing station of an electrophotographic apparatus (Imagio Neo C455, Ricoh Company, Ltd.) followed by continuously printing a total of 400,000 sheets, under the condition of printing out 5 sheets at a time of a half-tone pattern having a pixel density of 600 dpi×600 dpi depicting 4 dots×4 dots in an 8×8 matrix, onto a copy paper (My Paper A4, NBS Ricoh Company, Ltd.). All of the zinc stearate rods were removed from the photoconductor assembly.

A spring for applying a load provided on the cleaning blade was changed to an SUS spring having a spring load of 0.60 N/mm, a free length of 14 mm and an inner diameter of 5 mm.

Genuine products originally provided with the Imagio Neo C455 were used for the toner and developer.

A genuine product was used for the photoconductor unit. A peak-to-peak voltage of 1.5 kV and frequency of 0.9 kHz were selected for the AC components of the voltage applied to the charging roller. In addition, a bias voltage was set for the DC component so that the charging potential of the photoconductor at the start of test was −700 V, and test was carried out under the charging condition until the test was completed. In addition, the developing bias voltage was set to −500 V. Furthermore, a charge-eliminating unit was not provided in the apparatus. In addition, test was carried out after changing to an unused genuine cleaning unit. Following completion of test, a color test chart was copied and printed onto Type 6200 A3 plain PPC paper. The test environment was at 23° C. and 55% RH.

Images were evaluated by measuring coefficients of friction and surface roughness on Examples 10 to 15 after test was completed.

TABLE 3

| | Friction coefficient | Rz (μm) | Image evaluation |
|---|---|---|---|
| Example 10 | 0.43 | 1.2 | 2 |
| Example 11 | 0.32 | 1.2 | 3 |
| Example 12 | 0.34 | 1.6 | 3 |
| Example 13 | 0.33 | 1.6 | 3 |
| Example 14 | 0.34 | 1.8 | 3 |
| Example 15 | 0.41 | 3.4 | 2 |

Based on the test results on Examples 10 to 15, a range of 0.05 μm to 1.0 μm was suitable for the average particle diameter of lubricating resin fine particles contained in the crosslinkable resin surface layer.

Example 16

An electrophotographic photoconductor was obtained in the same manner as in Example 8 with the exception of changing the 10.0 parts by mass of polyethylene wax (CERAFLUOR 991 manufactured by BYK-CERA B.V.) in the coating for crosslinkable resin surface layer of Example 8 to 1.3 parts by mass of a fluorine-based surfactant (Aron GF300, Toagosei Chemical Industry Co., Ltd.) and 8.7 parts by mass of PFA fine particles (Teflon MPE-056, Dupont-Mitsui Fluorochemicals Co., Ltd) dispersed to have an average particle diameter of 0.3 μm.

Furthermore, fluorine resin fine particles were dispersed to obtain a fluorine resin component coating by suitably diluting a mill base obtained by pouring 20 g of a zirconia ball medium having a diameter of 2 mm, 3 g of a fluorine resin powder and 0.16 g of a fluorine-based surfactant into a 20 ml sample bottle and applying vibrations for 2 hours at a dispersion strength of 1,600 rpm using a vibration shaker manufactured by ICA A.G. This was then combined with the crosslinkable resin component coating to obtain a coating for crosslinkable resin surface layer.

Example 17

An electrophotographic photoconductor was obtained in the same manner as in Example 8 with the exception of changing the 10.0 parts by mass of the polyethylene wax (CERAFLUOR 991 manufactured by BYK-CERA B.V.) in the coating for crosslinkable resin surface layer of Example 8 to 1.3 parts by mass of a fluorine-based surfactant (Aron GF300, Toagosei Chemical Industry Co., Ltd.) and 8.7 parts by mass of PTFE fine particles (Lubron L2, Daikin Industries, Ltd.) dispersed to have an average particle diameter of 0.3 μm. Furthermore, a coating was prepared in the same manner as in Example 16.

After preparing the electrophotographic photoconductors of Examples 16 and 17 produced in the manner described above for mounting, they were mounted in a black developing station of an electrophotographic apparatus (Imagio Neo C455, Ricoh Company, Ltd.) followed by continuously printing a total of 250,000 sheets, under the condition of printing out 5 sheets at a time of a half-tone pattern having a pixel density of 600 dpi×600 dpi depicting 4 dots×4 dots in an 8×8 matrix, onto a copy paper (My Paper A4, NBS Ricoh Company, Ltd.). All of the zinc stearate rods were removed from the photoconductor assembly.

A spring for applying a load provided on the cleaning blade was changed to an SUS spring having a spring load of 0.40 N/mm, a free length of 14 mm and an inner diameter of 5 mm.

Genuine products originally provided with the Imagio Neo C455 were used for the toner and developer.

A genuine product was used for the photoconductor unit. A peak-to-peak voltage of 1.5 kV and frequency of 0.9 kHz were selected for the AC components of the voltage applied to the charging roller. In addition, a bias voltage was set for the DC component so that the charging potential of the photoconductor at the start of test was −700 V, and test was carried out under the charging condition until the test was completed. In addition, the developing bias voltage was set to −500 V. Furthermore, a charge-eliminating unit was not provided in the apparatus. In addition, test was carried out by changing to an unused genuine cleaning unit for every 50,000 sheets printed. Following completion of test, a color test chart was copied and printed onto Type 6200 A3 plain PPC paper. The test environment was at 24° C. and 54% RH.

The results of evaluating images after the test was completed on Examples 16 and 17 are shown in Table 4 below along with the values for escape degree and amount of wear.

TABLE 4

| | Image evaluation | Escape degree | Amount of wear (μm) |
|---|---|---|---|
| Example 16 | 4 | 22 | 3.4 |
| Example 17 | 4 | 32 | 3.5 |

Photoconductors using fluorine resin fine particles for the lubricating fine particles also had superior durability for both image evaluation and escape degree. Since extremely low values were also obtained for the amount of wear, these photoconductors can be evaluated as having high durability.

What is claimed is:

1. An electrophotographic photoconductor comprising:

a conductive substrate;

a photosensitive layer over the conductive substrate; and a crosslinked resin surface layer over the conductive substrate, wherein the crosslinked resin surface layer comprises at least trimethylolpropane triacrylate, a dimethylpolysiloxane having a radically polymerizable functional group, and lubricating fine particles, the lubricating fine particles comprising at least a low molecular mass polyethylene having a viscosity-based molecular weight of 900, wherein the dimethylpolysiloxane having a radically polymerizable functional group is a modified dimethylpolysiloxane having a radically polymerizable functional group on one end thereof, and wherein the total mass of the dimethylpolysiloxane and the lubricating fine particles is 5% by mass to less than 20% by mass based on the mass of the solid content of the crosslinked resin surface layer, and the dimethylpolysiloxane and the lubricating fine particles are mixed at a mass ratio of 3:7 to 7:3.

2. The electrophotographic photoconductor according to claim 1, wherein the crosslinked resin surface layer further comprises a crosslinked monofunctional radically polymerizable compound having a charge transporting structure, and the crosslinkable monofunctional radically polymerizable compound is represented by General Formula 1, and is contained at a ratio of 5% by mass to less than 60% by mass based on the mass of the solid content of the crosslinked resin surface layer:

General Formula 1

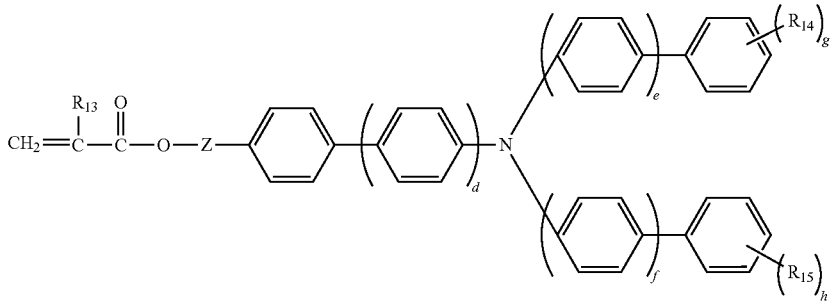

wherein, d, e and f each represents an integer of 0 or 1, $R_{13}$ represents a hydrogen atom or methyl group, $R_{14}$ and $R_{15}$ each represents an alkyl group having 1 to 6 carbon atoms and may be different in the case of a plurality of groups, g and h each represents an integer of 0 to 3, and Z represents a single bond, methylene group, ethylene group, or one of the groups indicated below:

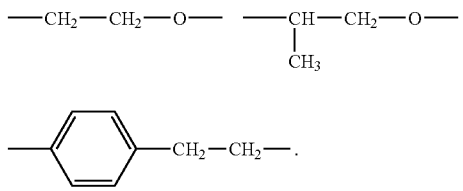

3. A process cartridge comprising the electrophotographic photoconductor according to claim 1.

4. An electrophotographic apparatus comprising the electrophotographic photoconductor according to claim 1.

* * * * *